US011114795B2

(12) United States Patent
Miyamura et al.

(10) Patent No.: US 11,114,795 B2
(45) Date of Patent: Sep. 7, 2021

(54) MALE TERMINAL, MALE CONNECTOR, JIG AND METHOD FOR ASSEMBLING MALE CONNECTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Tetsuya Miyamura, Mie (JP); Hajime Kawase, Mie (JP); Hajime Matsui, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/754,125

(22) PCT Filed: Oct. 2, 2018

(86) PCT No.: PCT/JP2018/036829
§ 371 (c)(1),
(2) Date: Apr. 6, 2020

(87) PCT Pub. No.: WO2019/077992
PCT Pub. Date: Apr. 25, 2019

(65) Prior Publication Data

US 2020/0287315 A1 Sep. 10, 2020

(30) Foreign Application Priority Data

Oct. 18, 2017 (JP) ..... JP2017-201818

(51) Int. Cl.
*H01R 13/436* (2006.01)
*H01R 13/04* (2006.01)

(52) U.S. Cl.
CPC ..... *H01R 13/4368* (2013.01); *H01R 13/04* (2013.01)

(58) Field of Classification Search
CPC ..... H01R 13/4538; H01R 13/4362; H01R 13/4361; H01R 13/4368; H01R 13/04
(Continued)

(56) References Cited

U.S. PATENT DOCUMENTS 5,438,748 A 8/1995 Matsuzawa
5,518,428 A * 5/1996 Onoda ..... H01R 13/4223 439/595

(Continued)

FOREIGN PATENT DOCUMENTS

JP 49-135790 11/1974
JP 6-29082 4/1994

(Continued)

OTHER PUBLICATIONS

International Search Report dated Dec. 4, 2018.

*Primary Examiner* — Gary F Paumen
(74) *Attorney, Agent, or Firm* — Gerald E. Hespos; Michael J. Porco; Matthew T. Hespos

(57) ABSTRACT

A male terminal 10 is provided with a terminal body 15 including a tab 40 extending forward, and a cover 16 slidable between a protection position for accommodating the tab 14 inside a sheath portion 24 and a retracted position for exposing a front end part of the tab 14 from a front end of the sheath portion 24, and the cover 16 is made of a magnetic material.

7 Claims, 28 Drawing Sheets

(58) Field of Classification Search
USPC ..... 439/140, 141, 752
See application file for complete search history.

(56) References Cited

U.S. PATENT DOCUMENTS

| | | | | |
|---|---|---|---|---|
| 6,083,024 | A | 7/2000 | Mezin et al. | |
| 10,249,986 | B2 | 4/2019 | Miyamura et al. | |
| 2001/0051468 | A1 | 12/2001 | Kashiyama et al. | |
| 2014/0120753 | A1* | 5/2014 | Liang | H01R 13/4538 439/157 |
| 2015/0038009 | A1* | 2/2015 | Gibson | H01R 24/525 439/578 |
| 2015/0280330 | A1 | 10/2015 | Oka | |

FOREIGN PATENT DOCUMENTS

| | | |
|---|---|---|
| JP | 10-302908 | 11/1998 |
| JP | 2001-345140 | 12/2001 |
| JP | 2004-31186 | 1/2004 |
| JP | 2015-185448 | 10/2015 |
| JP | 2015-198004 | 11/2015 |
| JP | 2016-146240 | 12/2016 |
| WO | 2015-164754 | 10/2015 |

* cited by examiner

MALE TERMINAL, MALE CONNECTOR, JIG AND METHOD FOR ASSEMBLING MALE CONNECTOR

BACKGROUND

Field of the Invention

This specification relates to protecting a tab of a male terminal.

Related Art

Japanese Unexamined Patent Publication No. 2015-185448 discloses a male terminal including a tab projecting forward from a terminal body. The male terminal is connected electrically to a female terminal including a connecting tube into which the tab is insertable.

A resilient contact piece is disposed inside the connecting tube of the female terminal fitting and serves as an electrical contact with the tab. Thus, external matter is not likely to collide with the resilient contact piece and the resilient contact piece is not likely to be deformed.

However, the tab of the male terminal projects and external matter may collide with this tab. Thus, the tab may be deformed and a predetermined contact pressure may not be obtained between the tab and the resilient contact piece of the female terminal.

The invention disclosed in this specification was completed on the basis of the above situation and aims to protect a tab of a male terminal.

SUMMARY

This specification is directed to a male terminal with a terminal body including a tab extending forward, and a cover slidable between a protection position for accommodating the tab inside a sheath and a retracted position for exposing a front part of the tab from a front end of the sheath. The cover includes a magnet or a magnetic material.

According to this configuration, the tab can be accommodated inside the sheath by moving the cover to the protection position. Thus, the tab is protected from collision with external matter. Further, a mating terminal and the tab can be connected electrically by moving the cover to the retracted position to expose the tab.

Further, the magnet enables the cover to be moved to the protection position or retracted position by a magnetic force acting between the magnet and the cover without directly touching the cover.

The tab and the terminal body may include a front retaining portion for engaging a front retaining/engaging portion on the cover from the front to restrict forward movement of the cover beyond the protection position. Accordingly, the cover is prevented from coming off forward.

The tab or the terminal body may include a rear retaining portion for engaging a rear retaining/engaging portion on the cover from behind to restrict rearward movement of the cover beyond the retracted position. Accordingly, the cover is prevented from coming off rearward.

The specification also is directed to a male connector that includes the above-described male terminal, a connector housing with a cavity for accommodating the male terminal, and a retainer. The retainer is movable with respect to the connector housing between a partial locking position separated from the male terminal and a full locking position where the retainer contacts and retains the male terminal. The connector housing is provided with a full locking portion for locking the retainer and holding the retainer at the full locking position. A cam pin projects outward on an outer surface of the retainer. The retainer is moved to the full locking position with the cam pin located in a starting end of a cam groove provided in a jig and the retainer is moved to the partial locking position with the cam pin moved to a final end of the cam groove.

The specification also is directed to a jig with an accommodation recess for accommodating the above-described male connector. A cam groove is formed in an inner wall of the accommodation recess and extends along an inserting direction of the male connector into the accommodation recess. The retainer is moved to the full locking position with the cam pin fit in a starting end of the cam groove and the retainer is moved to the partial locking position with the cam pin moved to a final end of the cam groove. A magnet is provided in front of the accommodation recess in the inserting direction and attracts the cover of the male terminal by a magnetic force.

According to the above-described configuration, if the male connector is accommodated into the accommodation recess of the jig, the cam pin of the retainer moves to the final end part of the cam groove and the retainer moves to the partial locking position. Since the retainer is disposed at the position separated from the male in this state, the male terminal can be mounted into the connector housing.

The cover includes the magnetic material or magnet that is attracted to the magnet in the jig. Thus, the cover moves forward with respect to the inserting direction of the male connector to the protection position. The tab can be accommodated into the sheath of the cover in this way. Therefore, the tab is protected from collision from external matter.

If the male connector is moved rearward with respect to the inserting direction from the accommodation recess, the cam pin moves in the cam groove and reaches the starting end of the cam groove. Thus, the retainer moves to the full locking position, and the retainer is held at the full locking position by the full locking portion of the connector housing. The retainer is held in contact with the male terminal at the full locking position and retains the male terminal.

With the male connector pulled out of the jig, the male terminal is retained by the retainer held at the full locking position, and the tab is accommodated and protected in the cover. Thus, protecting the tab does not require moving the cover when the male connector is removed from the jig, and an assembling process of the male connector can be simplified.

This specification also is directed to a method for assembling a male connector. The method includes assembling a male terminal by assembling a terminal body including a tab extending forward with a cover that is slidable between a protection position for accommodating the tab inside a sheath and a retracted position for exposing a front end of the tab from a front end of the sheath. The method also includes assembling a connector housing with a retainer. The connector housing includes a cavity for accommodating the male terminal. The retainer is movable with respect to the connector housing to a partial locking position separated from the male terminal and a full locking position for contacting and retaining the male terminal. The retainer is moved to the partial locking position by pushing the male connector into the accommodation recess while fitting a cam pin projecting outward on an outer surface of the retainer into a cam groove provided in an inner wall of the accommodation recess in a jig. The method further includes inserting the male terminal into the cavity, attracting the cover of the male terminal by a magnetic force of a magnet disposed in front of the accommodation recess in an inserting direction of the male connector into the accommodation recess in the jig, and moving the cam pin to a starting part of the cam groove and moving the retainer to the full locking position by pulling the male connector out of the accommodation recess of the jig.

DETAILED DESCRIPTION

One embodiment of the invention disclosed in this specification is described with reference to FIGS. 1 to 28. A male terminal 10 according to this embodiment is accommodated in a male connector 11. In the following description, it is assumed that a Z direction is an upward direction, a Y-direction is a forward direction and an X-direction is a leftward direction. Further, only some of a plurality of identical members may be denoted by a reference sign and the other members may not be denoted by the reference sign.

Male Terminal 10

Figure 1:
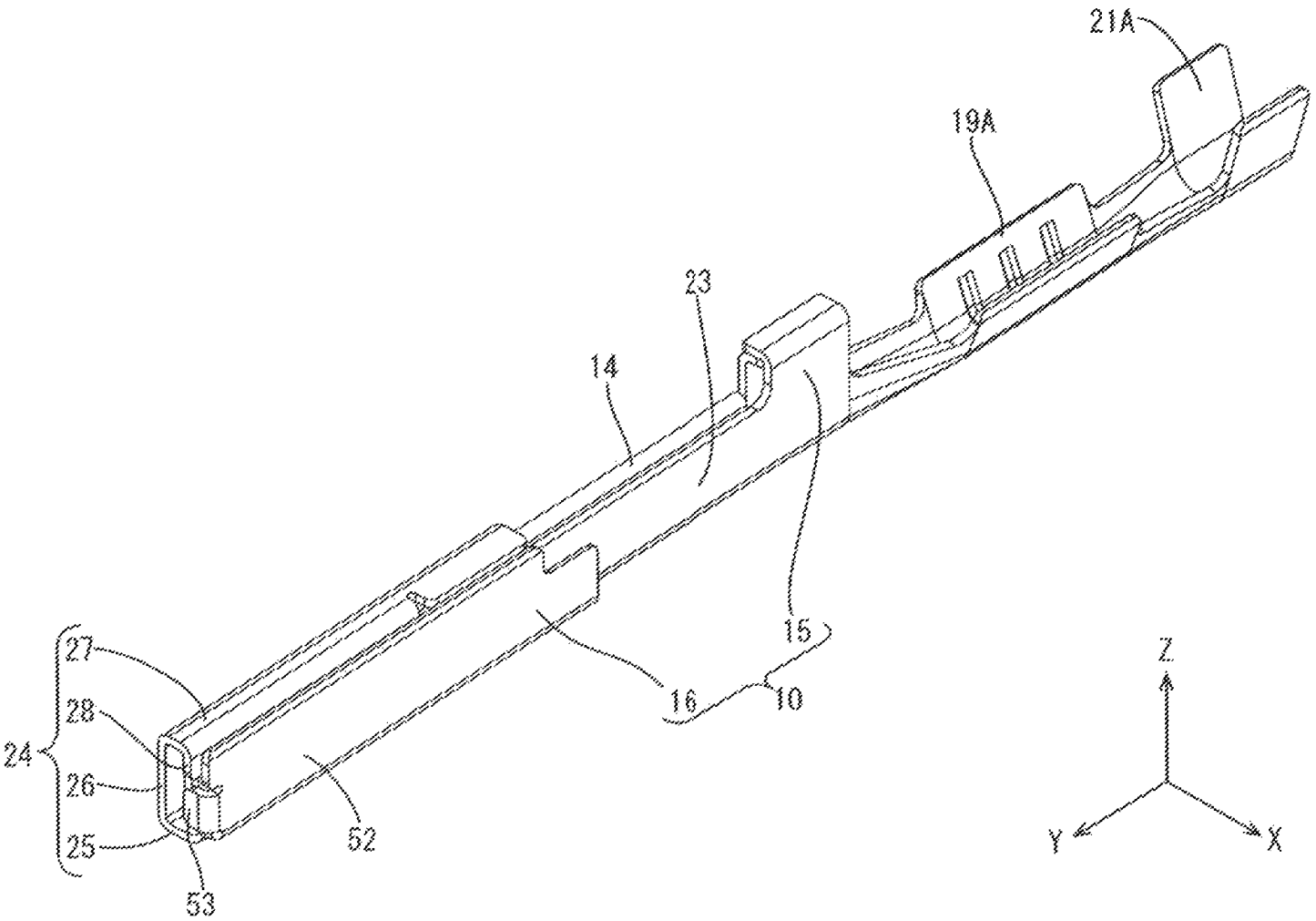
FIG. 1 is a perspective view of a male terminal according to one embodiment showing a state where a cover is disposed at a protection position.
Figure 2:
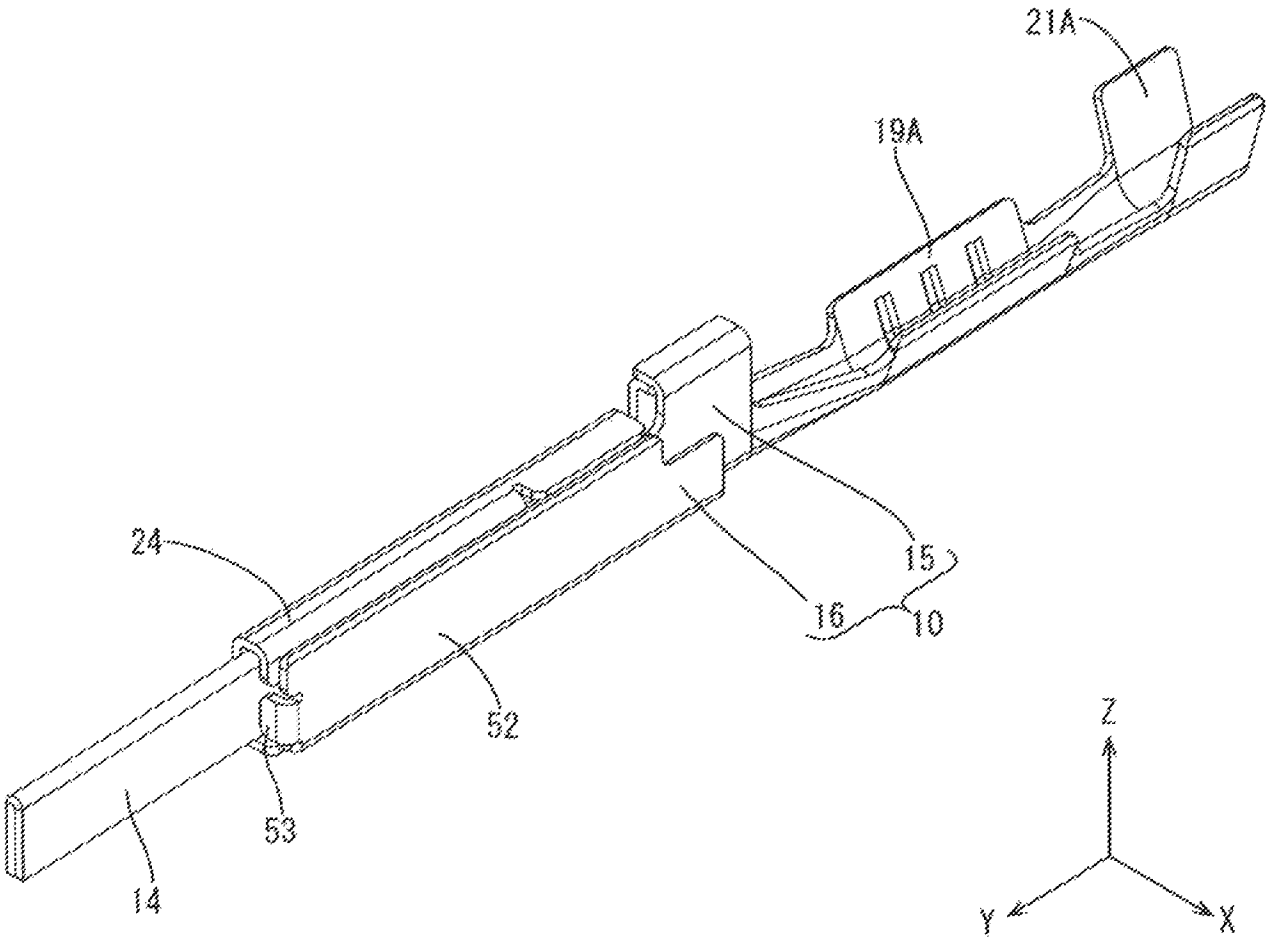
FIG. 2 is a perspective view showing a state where the cover is disposed at a retracted position.
Figure 3:
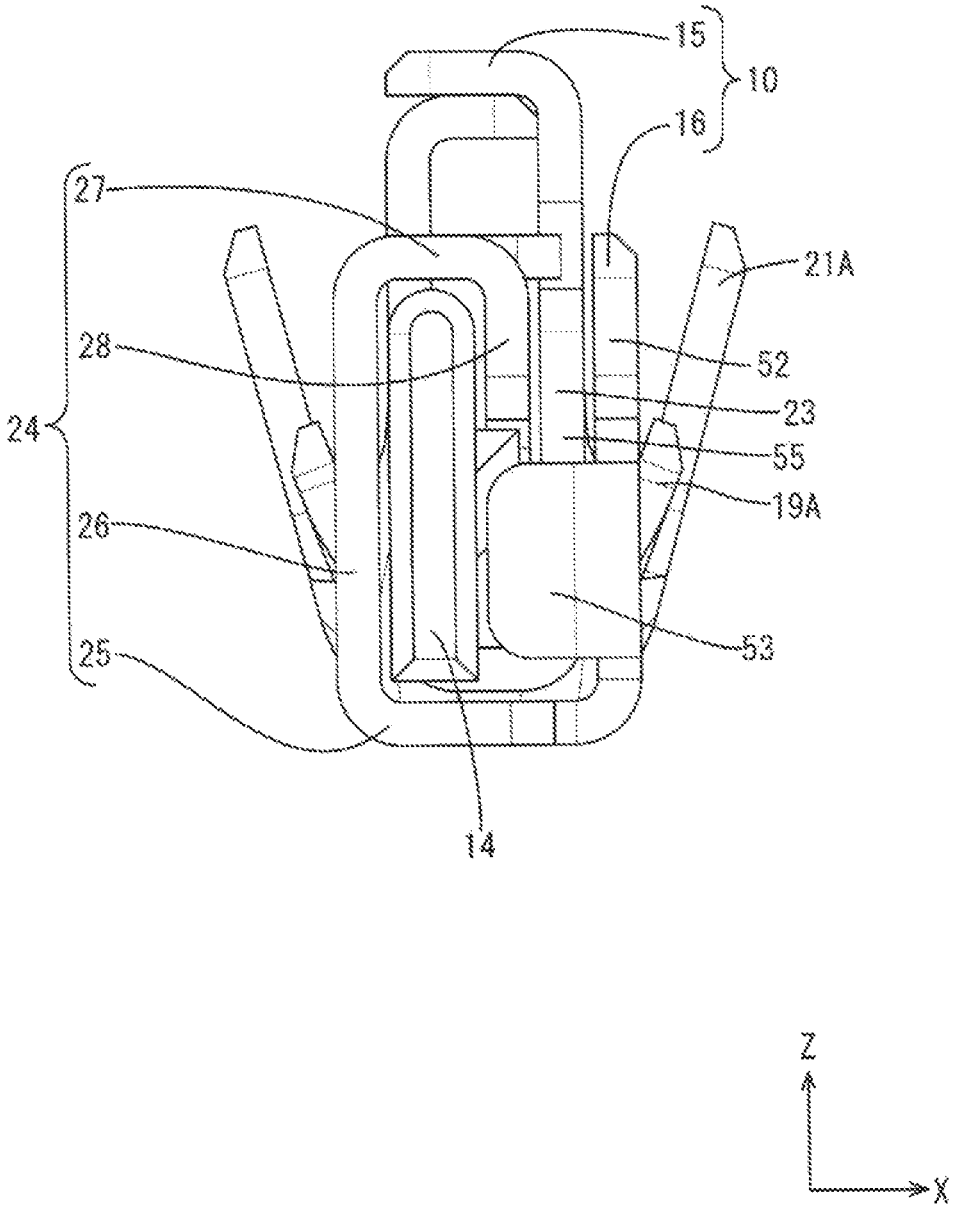
FIG. 3 is a front view showing the male terminal.

As shown in FIGS. 1 to 3, the male terminal 10 includes a rectangular tubular terminal body 15 having a tab 14 extending forward, and a cover 16 having a sheath capable of accommodating the tab 14.

Terminal Body 15

Figure 4:
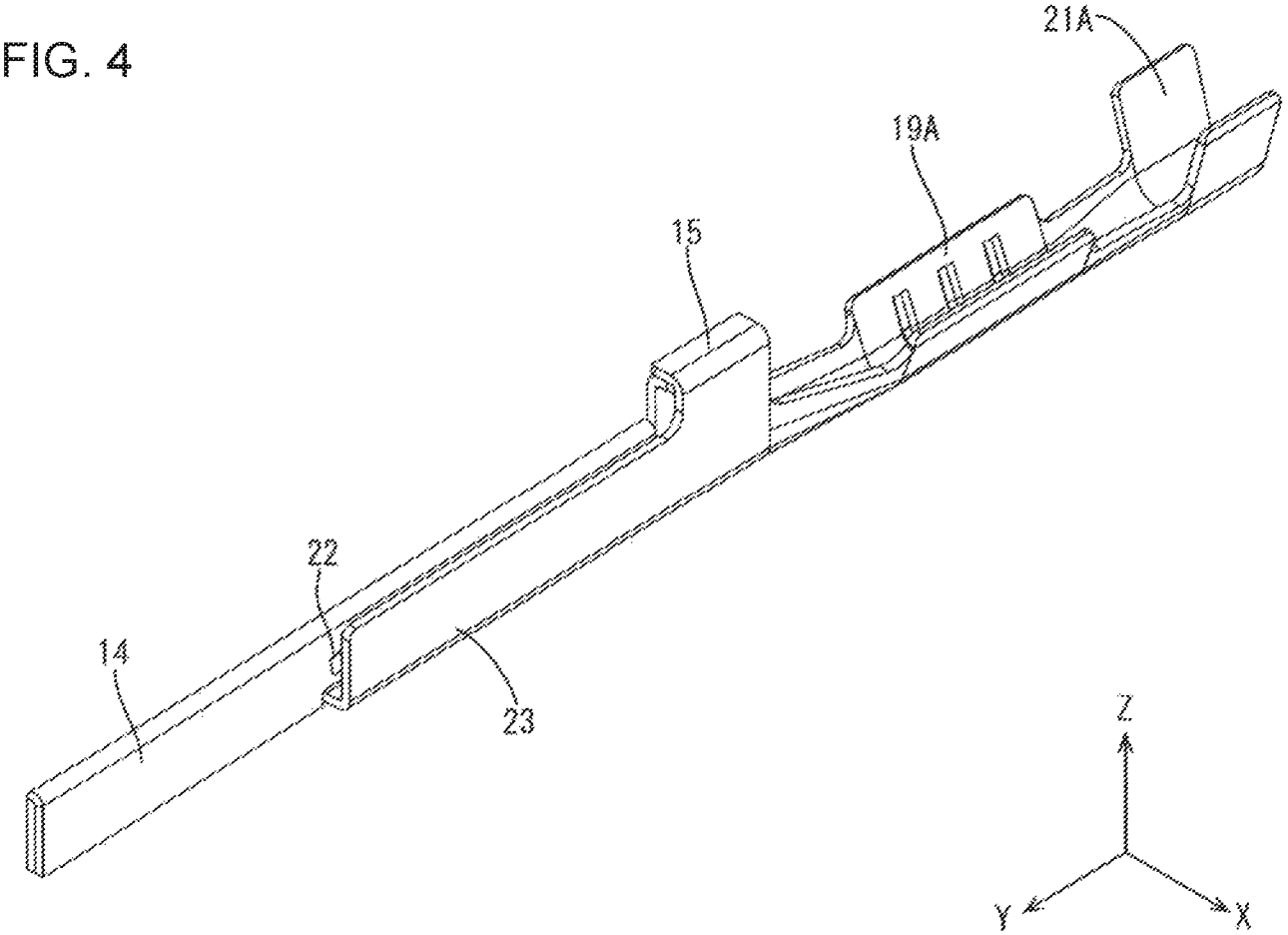
FIG. 4 is a perspective view showing a terminal body.
Figure 5:
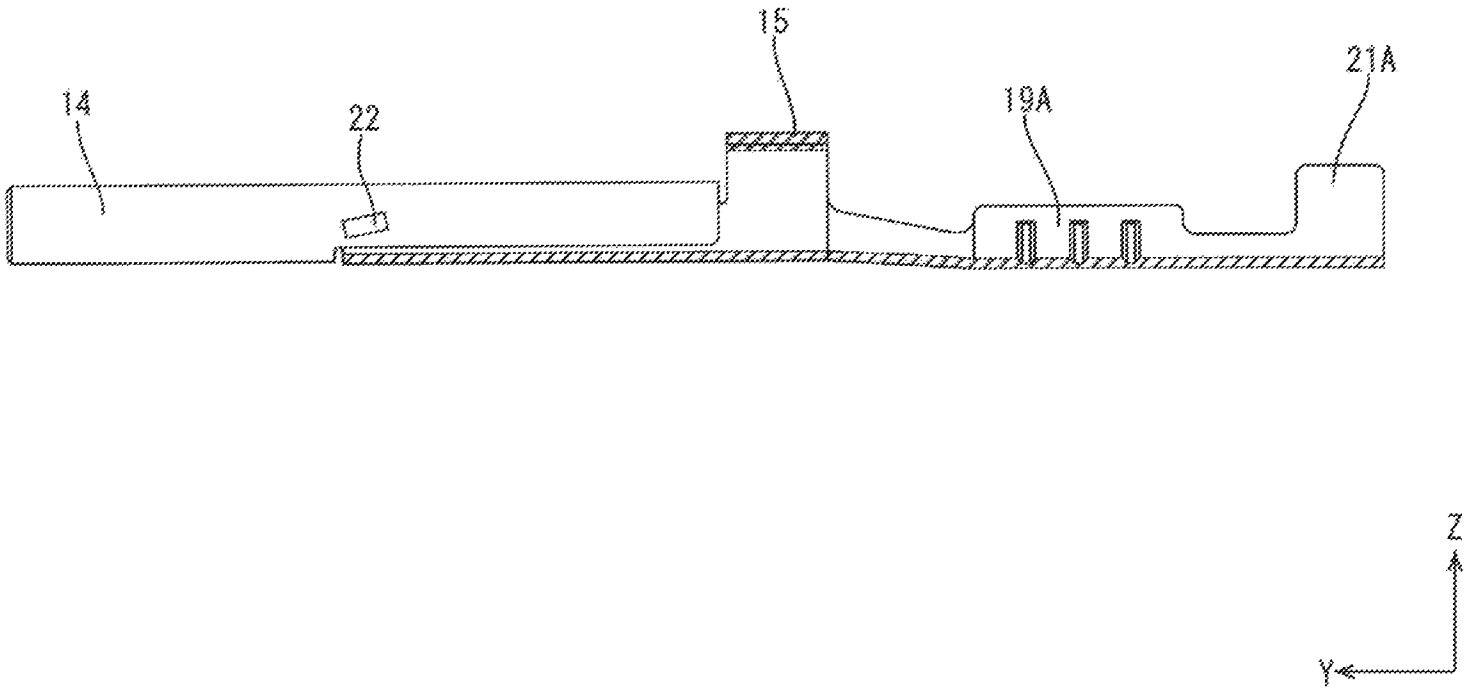
FIG. 5 is a section showing the terminal body.
Figure 6:
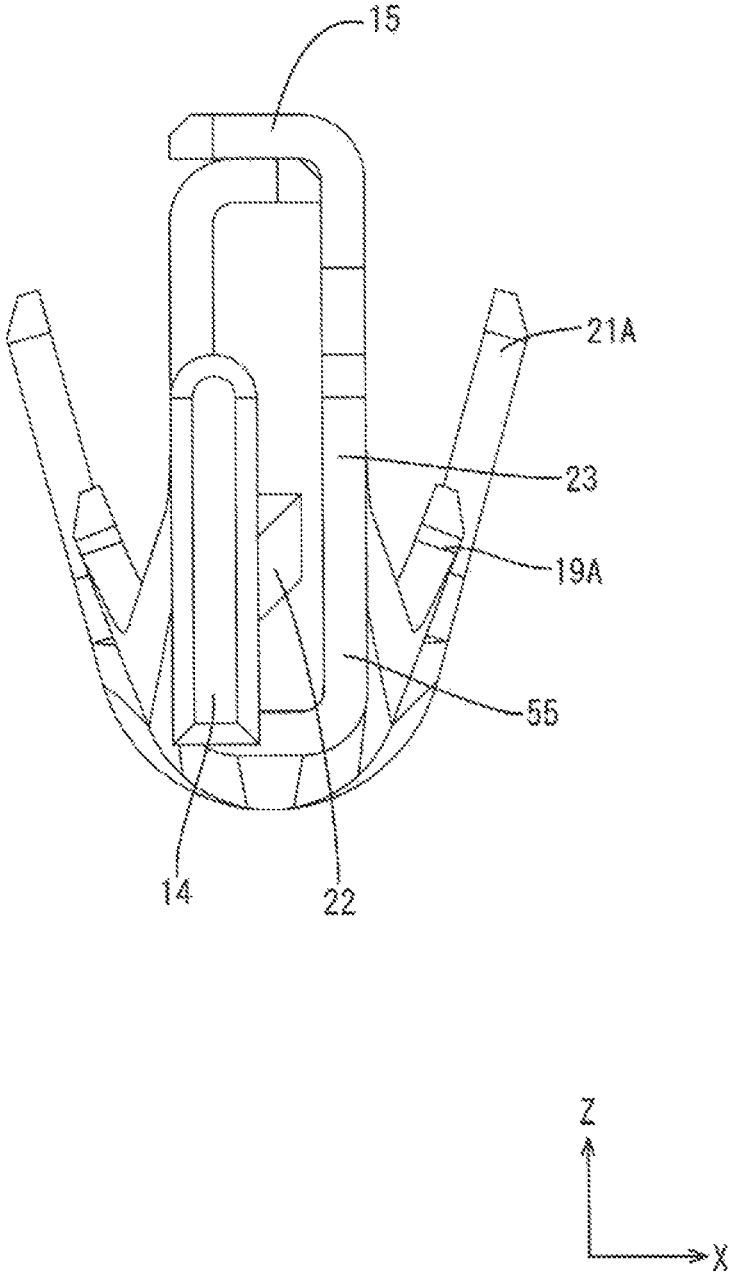
FIG. 6 is a front view showing the terminal body.

As shown in FIGS. 4 to 6, the terminal body 15 is formed by press-working a metal plate material into a predetermined shape. A metal, such as copper, copper alloy, aluminum or aluminum alloy, can be selected according to need as a metal constituting the terminal body 15. The terminal body 15 according to this embodiment is made of copper or copper alloy. A plating layer is formed on a surface of the terminal body 15. A metal, such as tin or nickel, can be selected according to need as a metal for forming the plating layer. A tin plating layer is formed on the surface of the terminal body 15 in this embodiment.

The terminal body 15 is a rectangular tube that is flat in a lateral direction. A wire barrel 19A to be crimped to a core 18A of a wire 17A is formed behind the terminal body 15. An insulation barrel 21A to be crimped to an insulation coating 20A surrounding the outer periphery of the core 18A is formed behind the wire barrel 19A.

The tab 14 is formed into a plate shape that is flat in the lateral direction by folding the metal plate material. When viewed laterally, the tab 14 has a rectangular shape that is elongated in a front-rear direction. A front retaining portion 22 is provided near a center of the tab 14 in the front-rear direction. The front retaining portion 22 is formed by cutting a part of the metal plate material of the tab 14 and raising the cut part leftward. The front retaining portion 22 has a rectangular shape when viewed from the left. A front part of the front retaining portion 22 is inclined somewhat down toward the front as compared to a rear end part.

An extending wall 23 extends forward on a left side wall of the terminal body 15. The extending wall 23 extends parallel to the tab 14 while being laterally spaced apart from the tab 14. A length of the extending wall 23 in the front-rear direction is substantially half that of the tab 14. Thus, a front part of the tab 14 projects forward from a front part of the extending wall 23. The front retaining portion 22 formed on the tab 14 is located behind the front part of the extending wall 23.

The upper edges of the tab 14 and the extending wall 23 are at substantially the same height position in a vertical direction. Vertical heights of the tab 14 and the extending wall 23 are substantially half that of the terminal body 15. In this way, the terminal body 15 projects farther up than the tab 14 and the extending wall 23.

Cover 16

As shown in FIGS. 1 to 3, the cover 16 is a substantially rectangular tube extending in the front-rear direction. The cover 16 includes the sheath 24 capable of accommodating the tab 14. The sheath 24 is a rectangular tube extending in the front-rear direction. An internal space of the sheath 24 is larger than a cross-section of the tab 14 perpendicular to the front-rear direction. In this way, the sheath 24 is slidable in the front-rear direction with respect to the tab 14.

Figure 7:
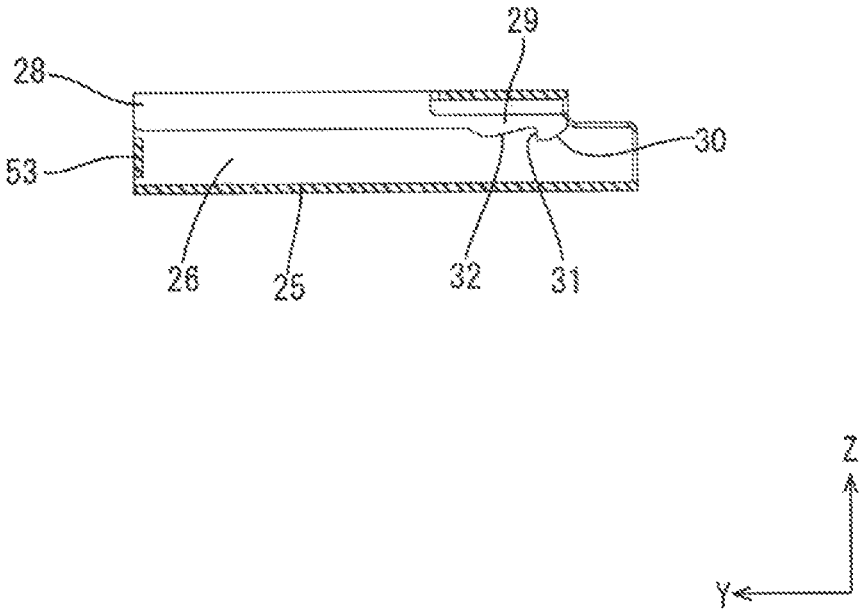
FIG. 7 is a section showing the cover.
Figure 8:
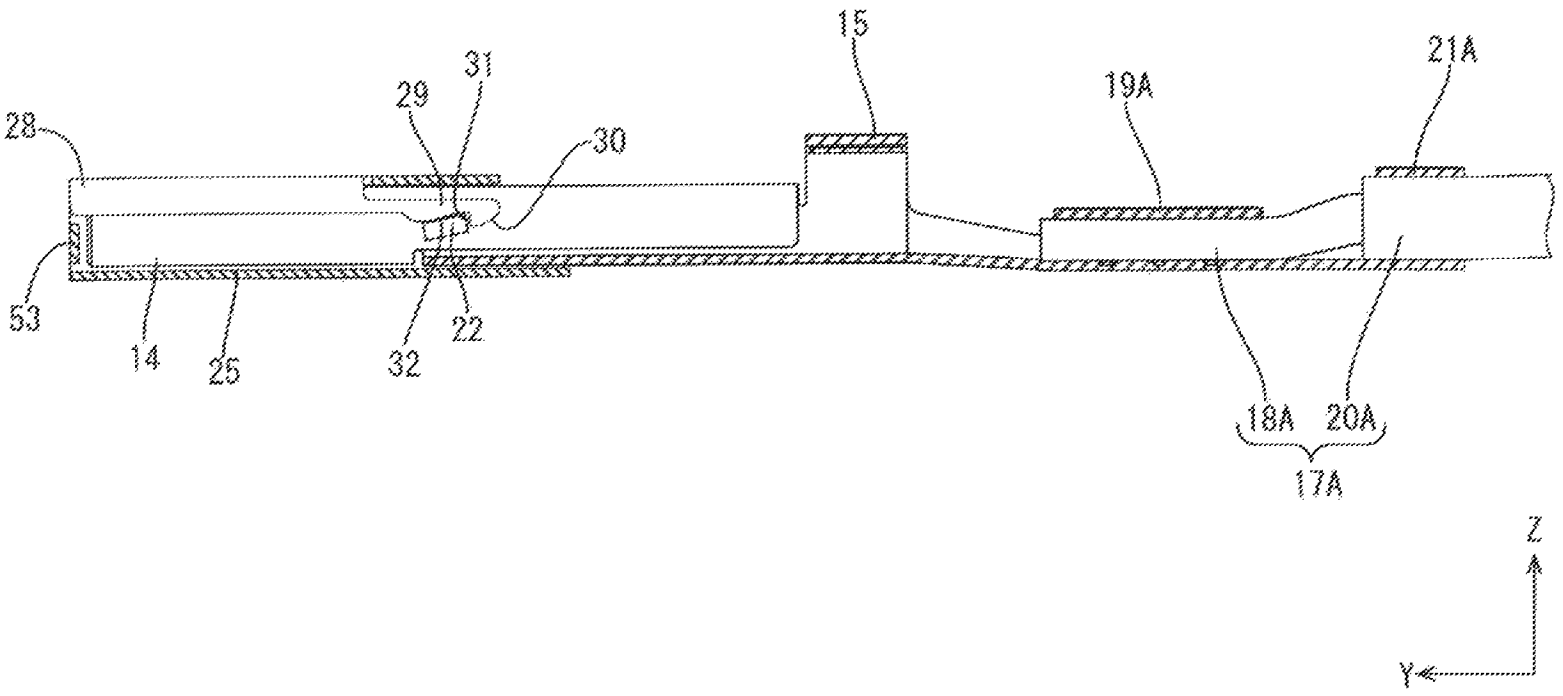
FIG. 8 is a section showing a state where the cover is disposed at the protection position in the male terminal connected to an end part of a wire.
Figure 9:
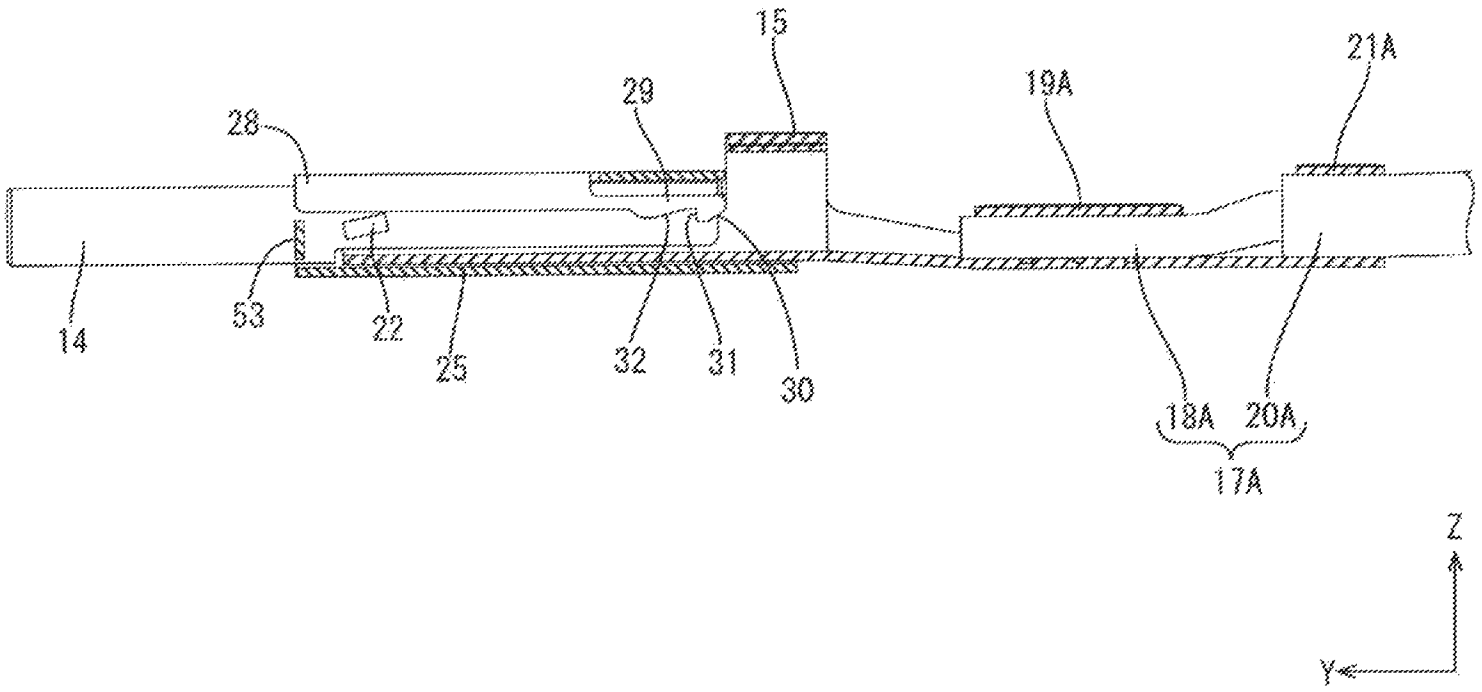
FIG. 9 is a section showing a state where the cover is disposed at the retracted position in the male terminal connected to the end part of the wire.

The sheath 24 includes a lower wall 25, a right side wall 26 rising from a right side of the lower wall 25, an upper wall 27 bent leftward from an upper end of the right side wall 26 and a left side wall 28 bent down from a left end of the upper wall 27. As shown in FIG. 7, a rear part of the left side wall 28 is formed with a front retaining/engaging portion 29 for contacting the front retaining/engaging portion 22 of the tab 14 from behind. The front retaining/engaging portion 29 is formed by cutting a lower end of the left side wall 28 upwardly, and is hook-shaped when viewed laterally. A rear end of the front retaining/engaging portion 29 is at substantially the same position or somewhat in front of a rear end of the upper wall 27. The front retaining/engaging portion 29 is resiliently deformable in the vertical direction.

A rear part of the front retaining/engaging portion 29 is formed with an assembling guiding surface 30 formed to incline down toward the front. A locking surface 31 cut upward and upright with respect to the front-rear direction is at a position somewhat in front of the assembling guiding surface 30. A semi-locking surface 32 is formed at a position in front of the locking surface 31 and is curved moderately when viewed laterally.

An outer side wall 52 extends in the front-rear direction on a left end of the lower wall 25 of the sheath 24 and a front part of the outer side wall 52 rises up. A length of the outer side wall 52 in the front-rear direction is equal to that of the sheath 24. A front part of the outer side wall 52 is formed with a rear retaining/engaging portion 53 bent rightward. A right end edge of the rear retaining/engaging portion 53 is disposed substantially at the same position as the left side wall 28 of the sheath 24 and does not project into the sheath portion 24.

The rear retaining/engaging portion 53 contacts a front end of the extending wall 23 of the terminal body 15 to prevent the cover 16 from coming off rearward. With the rear retaining/engaging portion 53 held in contact with a front end 55 (an example of a rear retaining portion) of the extending wall 23 of the terminal body 15 from the front, the tab 14 extends forward from a front part of the sheath 24 to be exposed. This state is a state where the cover 16 is at the retracted position with respect to the terminal body 15.

The cover 16 is formed by press-working a metal plate material into a predetermined shape. The cover 16 can be made from so-called magnetic materials, such as iron, iron alloy, nickel and nickel alloy.

Male Connector 11

Figure 10:
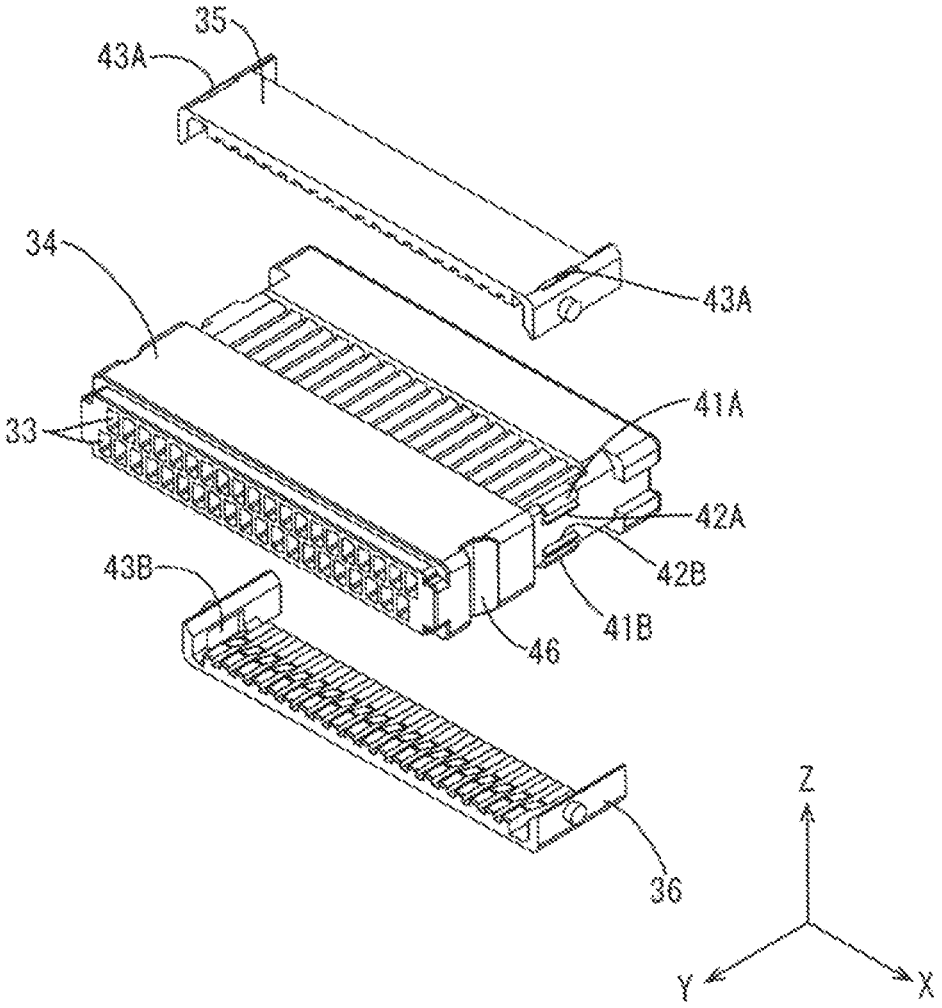
FIG. 10 is an exploded perspective view showing a male connector.
Figure 11:
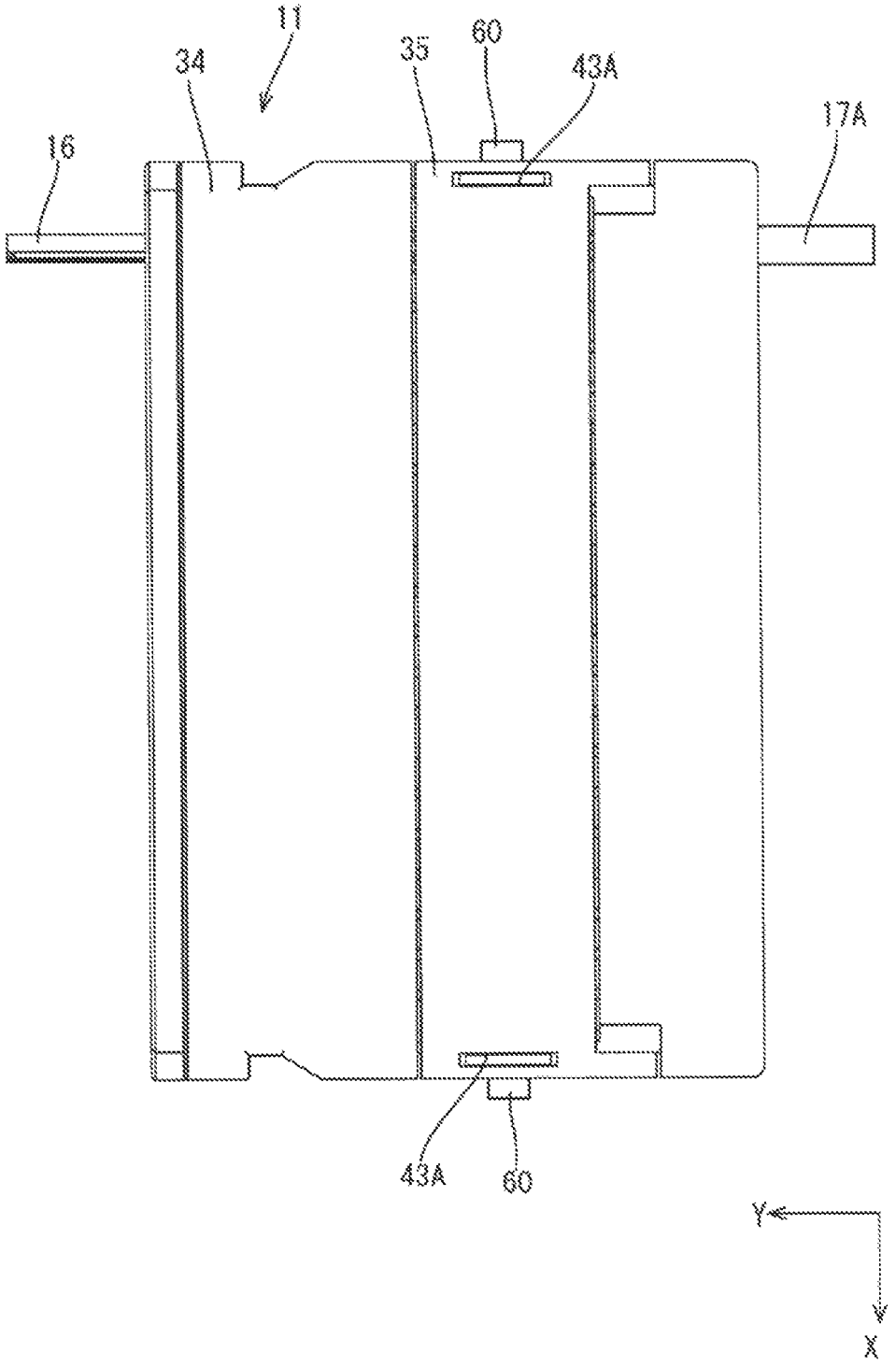
FIG. 11 is a plan view showing a state where an upper retainer and a lower retainer are held at partial locking positions.
Figure 12:
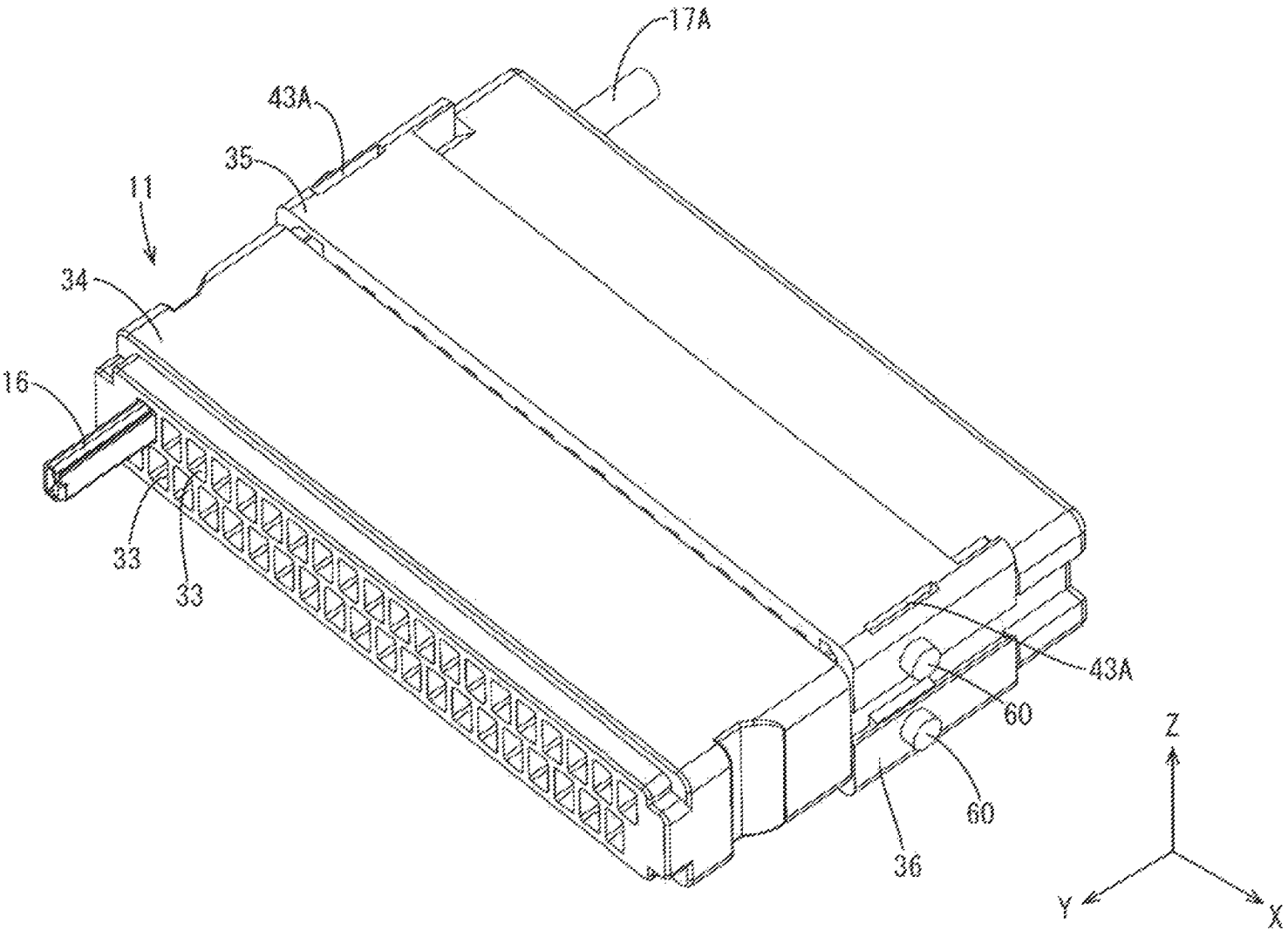
FIG. 12 is a perspective view showing the state where the upper retainer and the lower retainer are held at the partial locking positions.
Figure 13:
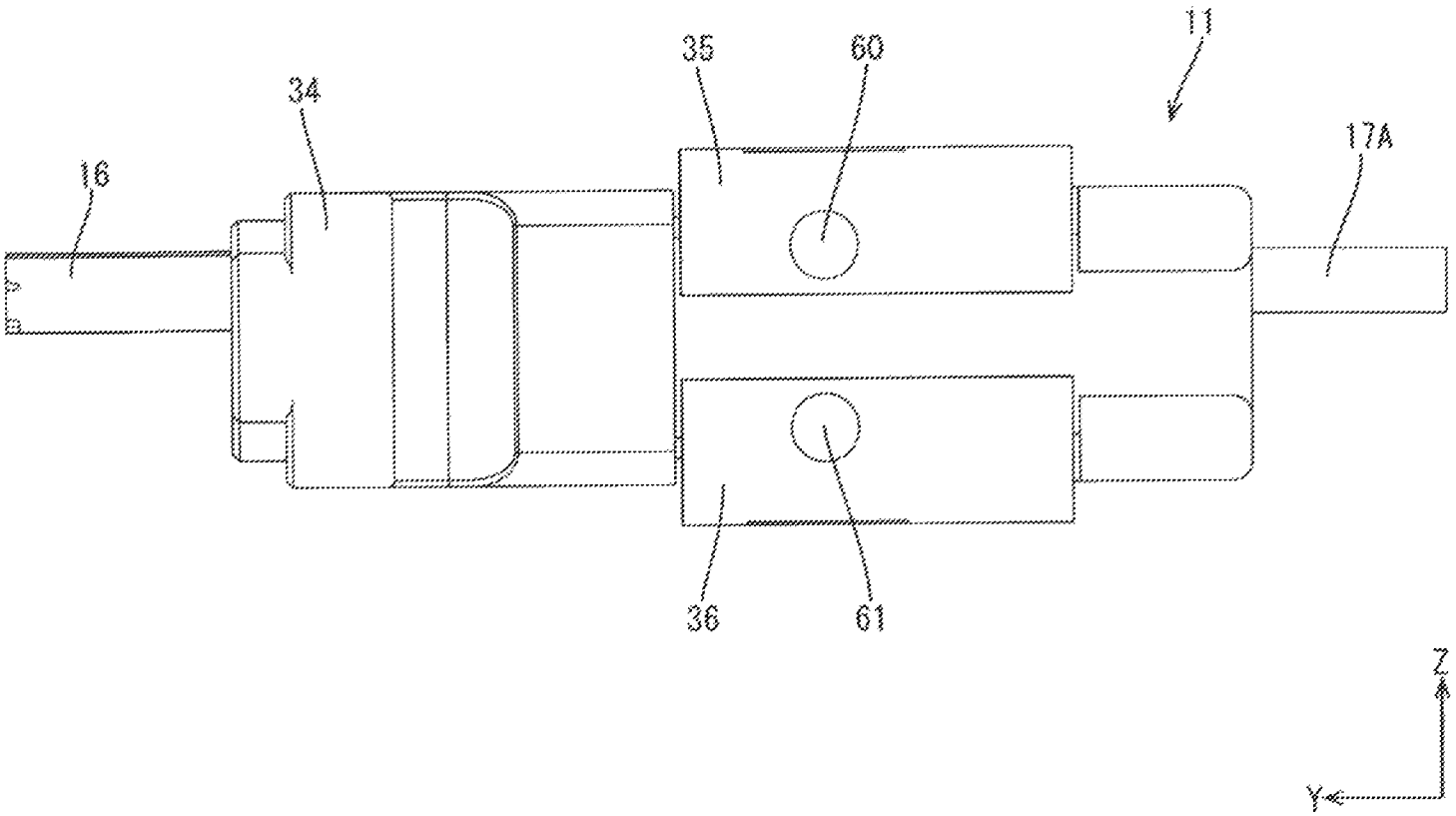
FIG. 13 is a side view showing the state where the upper retainer and the lower retainer are held at the partial locking positions.
Figure 14:
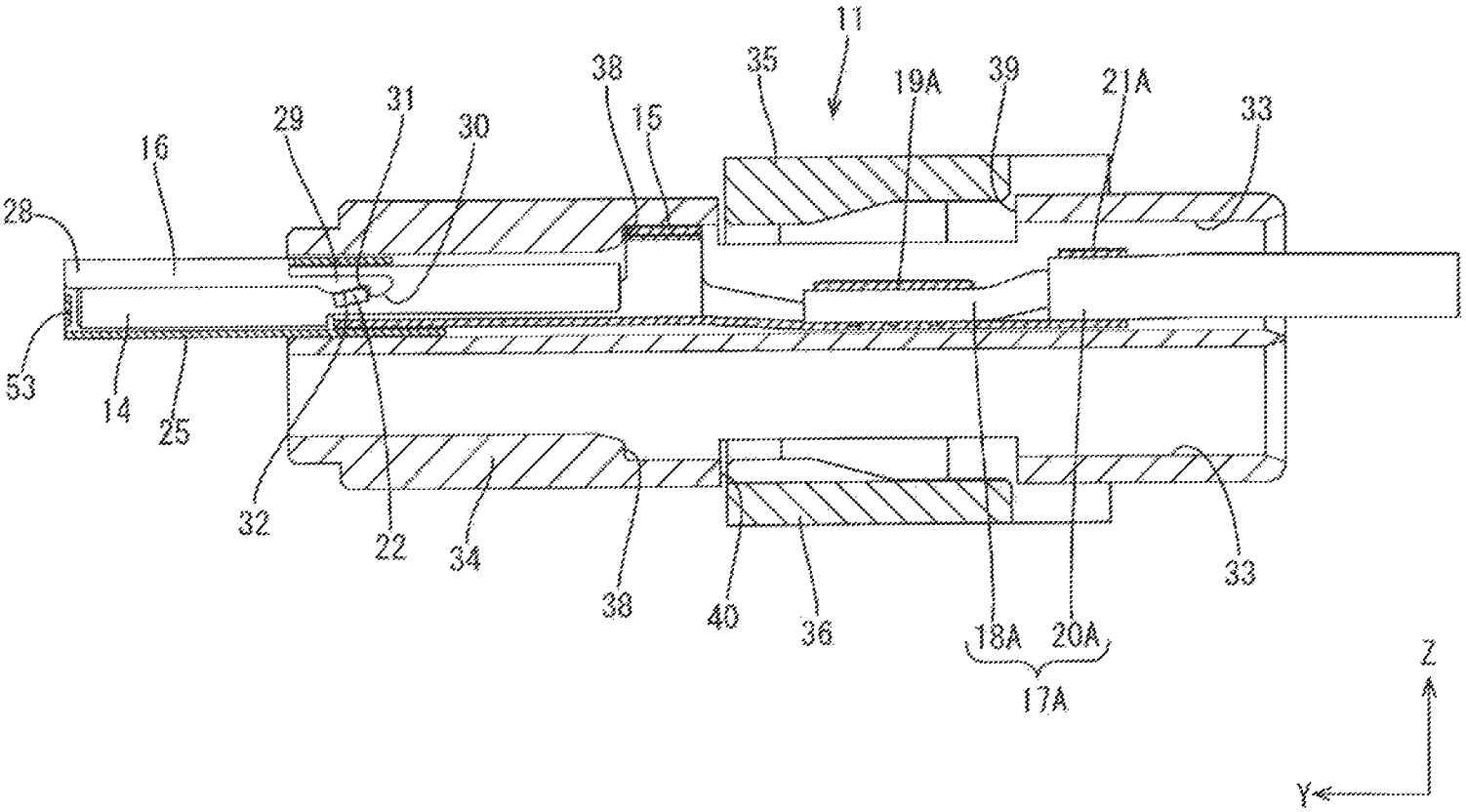
FIG. 14 is a section showing the state where the upper retainer and the lower retainer are held at the partial locking positions.
Figure 15:
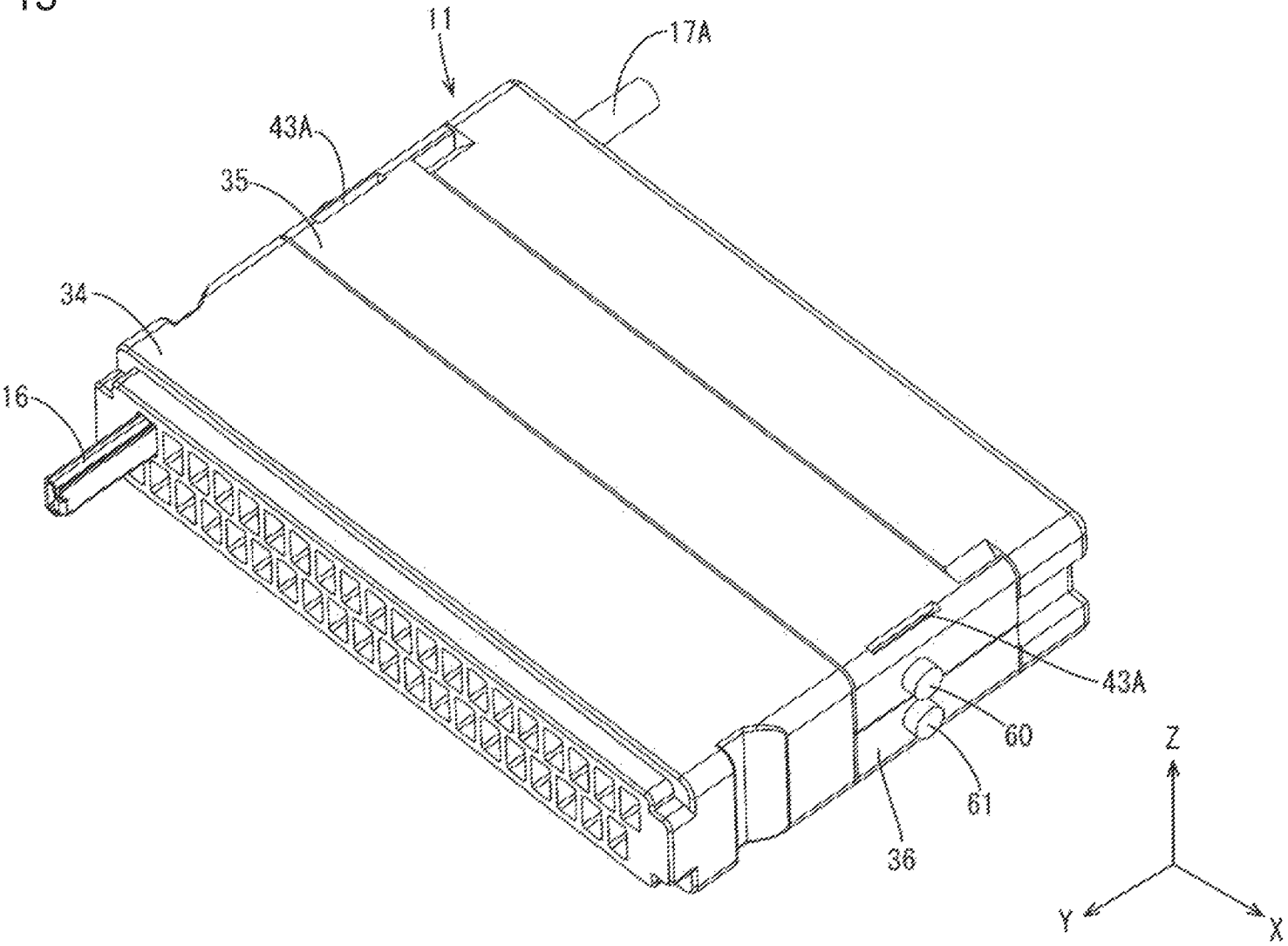
FIG. 15 is a perspective view showing a state where the upper retainer and the lower retainer are held at full locking positions.
Figure 16:
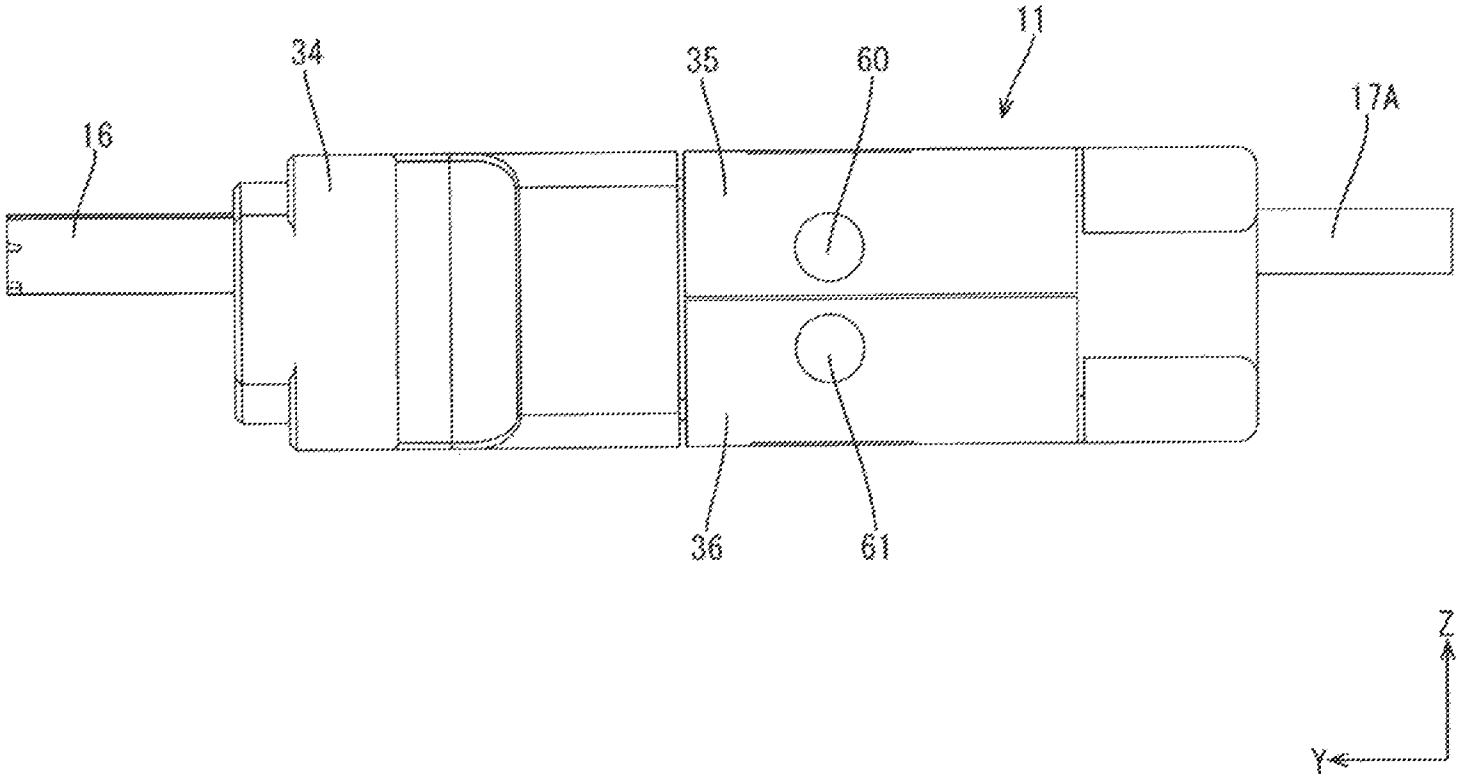
FIG. 16 is a side view showing the state where the upper retainer and the lower retainer are held at the full locking positions.
Figure 17:
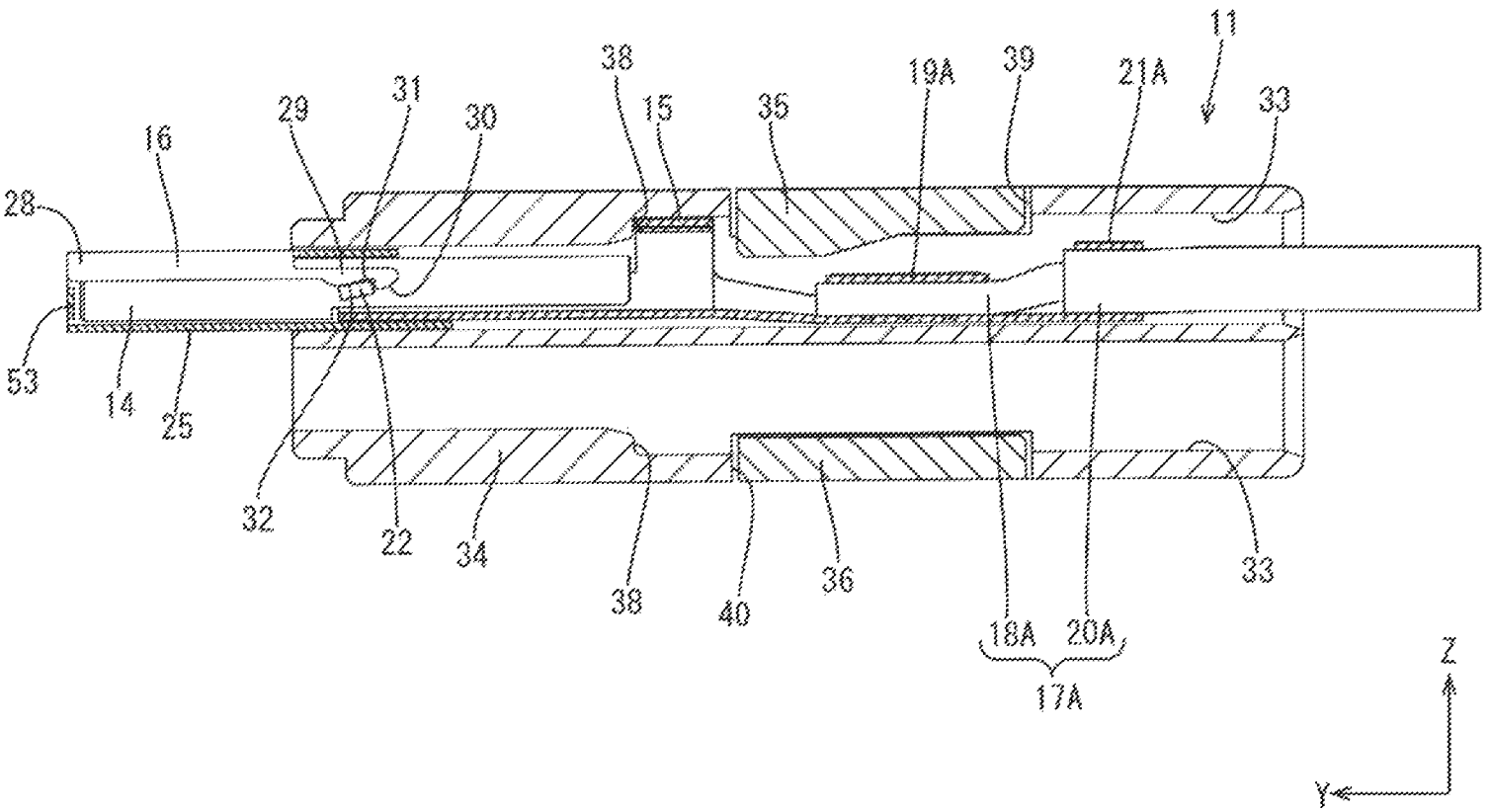
FIG. 17 is a section showing the state where the upper retainer and the lower retainer are held at the full locking positions.

As shown in FIG. 10, the male connector 11 is formed by injection-molding a synthetic resin. The male connector 11 includes a connector housing 34 having cavities 33 for accommodating the male terminals 10. The male connector 11 further has an upper retainer 35 and a lower retainer 36 for retaining the male terminals 10 by being assembled with the connector housing 34 and engaged with the male terminals 10.

Connector Housing 34

As shown in FIGS. 11 to 14, the connector housing 34 has a rectangular parallelepiped shape that is flat in the vertical direction. Cavities 33 are arranged side by side in the lateral direction in each of two upper and lower stages in the connector housing 34. The cavities 33 in the upper stage and those in the lower stage are at positions shifted in the lateral direction. Note that the number of the cavities 33 is arbitrary, and the cavities 33 may be formed side by side in one stage or three or more stages in the vertical direction. Each cavity 33 is open forward in a front end of the connector housing 34 and is open rearward in a rear end of the connector housing 34.

A region of an inner wall of the cavity 33 near a front part projects vertically inward. In this way, a step is formed at a position near the front part on the inner wall of the cavity 33. This step serves as a terminal front stop 38 with which a front end of the terminal body 15 of the male terminal 10 comes into contact.

An upper opening 39 is formed in the upper surface of the connector housing 34 to communicate with the cavities 33 in the upper stage, and a lower opening 40 is formed in the lower surface of the connector housing 34 to communicate with the cavities 33 in the lower stage. The upper retainer 35 is mounted into the upper opening 39 to close this upper opening 39, and the lower retainer 36 is mounted into the lower opening 40 to close this lower opening 40.

As shown in FIG. 10, a partial locking portion 41A for locking the upper retainer 35 at a partial locking position and a full locking portion 42A for locking the upper retainer 35 at a full locking position project laterally out on each side wall of the connector housing 34. The full locking portion 42A is at a position below the partial locking portion 41A. Lock receiving portions 43A are provided on both left and right parts of the upper retainer 35 to be locked resiliently to the partial locking portions 41A and full locking position 42A.

A partial locking portion 41B for locking the lower retainer 36 at a partial locking position and a full locking portion 42B for locking the lower retainer 36 at a full locking position project laterally outward on each side wall of the connector housing 34. The full locking portion 42B is at a position above the partial locking portion 41B. Lock receiving portions 43B are provided on both left and right parts of the lower retainer 36 to be locked resiliently to the partial locking portions 41B and full locking position 42B.

Upper cam pins 60 project laterally out on the outer surfaces of the side walls of the upper retainer 35, and lower cam pins 61 project laterally out on the outer surfaces of the side walls of the lower retainer 36. The upper and lower cam pins 60 and 61 have circular cross-sectional shapes.

Jig 62

Figure 18:
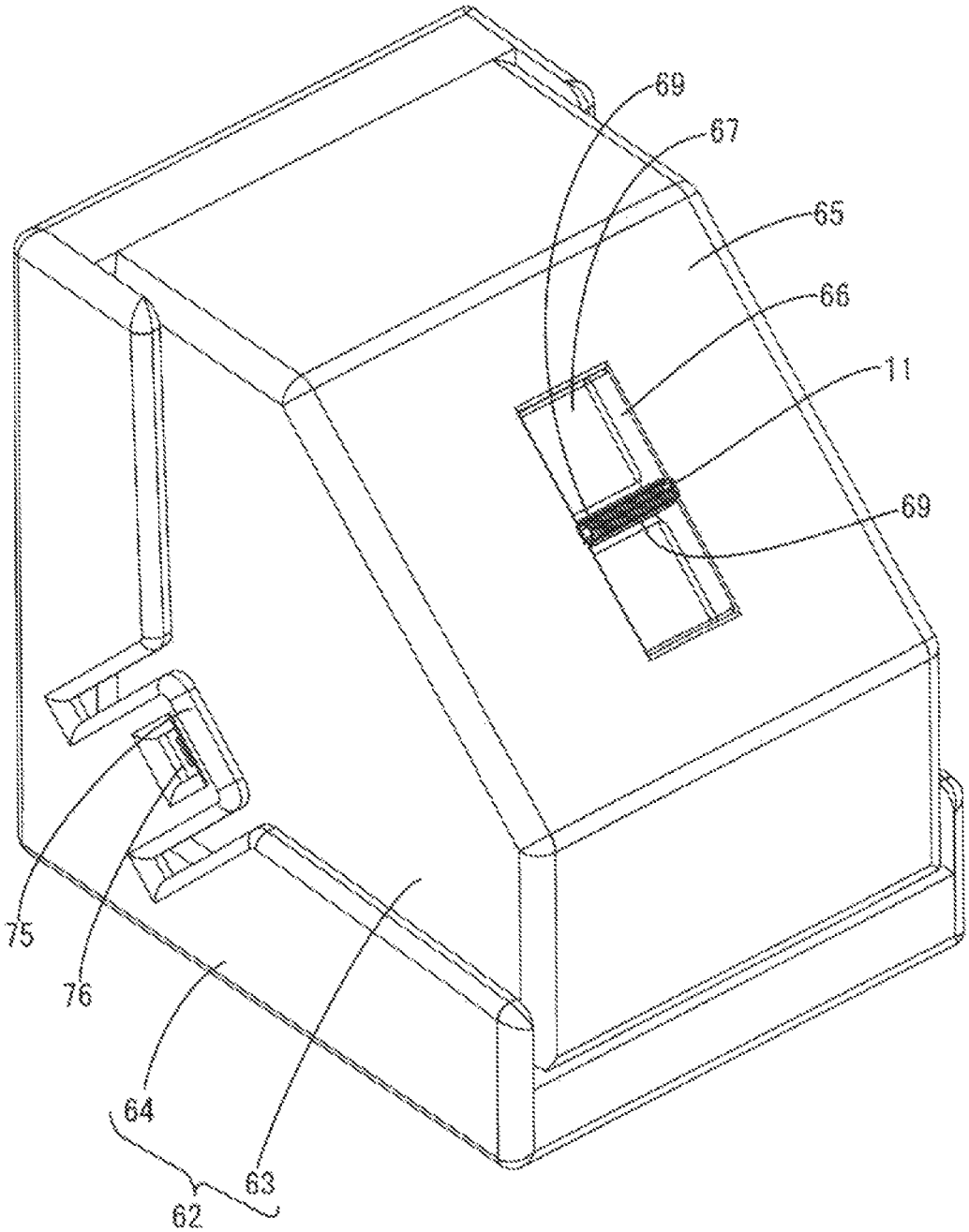
FIG. 18 is a perspective view showing a state where the male connector is mounted in a jig.

As shown in FIG. 18, the jig 62 includes a jig body 63 and a base 64 for holding this jig body 63. The jig body 63 has a shape substantially obtained by cutting one ridge of a rectangular parallelepiped to form an inclined surface inclined with respect to the vertical direction. This inclined surface serves as a work surface 65 for performing an assembling process of the male connector 11. The work surface 65 is recessed to form an accommodation recess 66 for accommodating the male connector. The accommodation recess 66 is recessed in a direction indicated by an arrow A. The male connector 11 is inserted into the accommodation recess 66 along the direction indicated by this arrow A, and the direction indicated by the arrow A serves as an inserting direction of the male connector 11.

Figure 26:
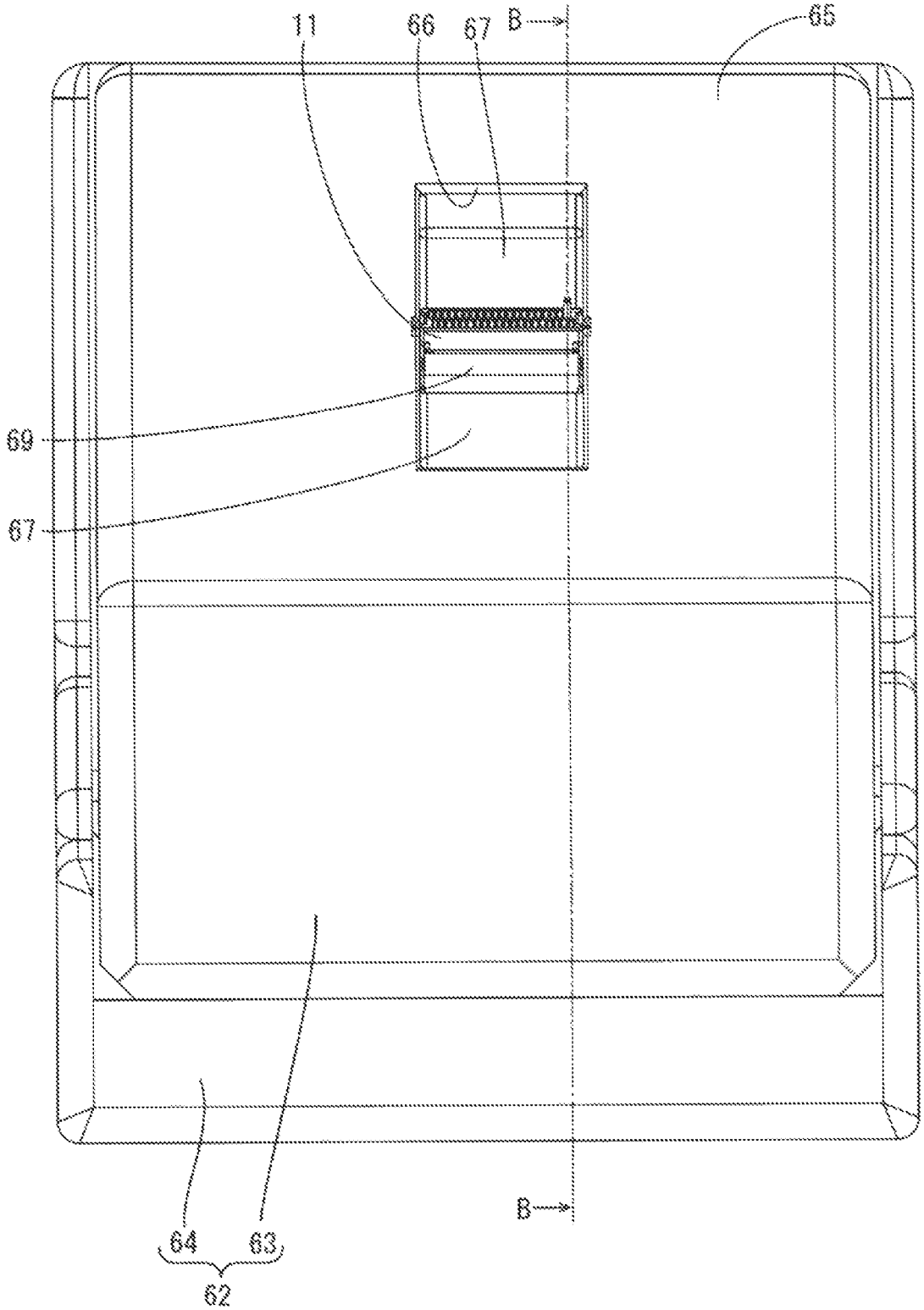
FIG. 26 is a front view showing a state where the male connector is mounted in the jig and the cover is attracted and held at the protection position by the magnetic force of the magnet.

As shown in FIG. 26, the accommodation recess 66 includes a work recess 67 and a connector holding recess 68. The work recess 67 is elongated in the vertical direction along the work surface 65 and is relatively shallow. The connector holding recess 68 is formed near a vertical center of the work recess 67 and has a flat shape elongated in the lateral direction. A cross-sectional shape of the connector holding recess 68 is the same as or somewhat larger than that of the male connector 11. Guiding slopes 69 are provided in a boundary part between the work recess 67 and the connector holding recess 68 and are expanded toward a rear side with respect to the inserting direction. The male connector 11 easily can be inserted into the connector holding recess 68 by being guided by these guiding slopes 69.

Figure 20:
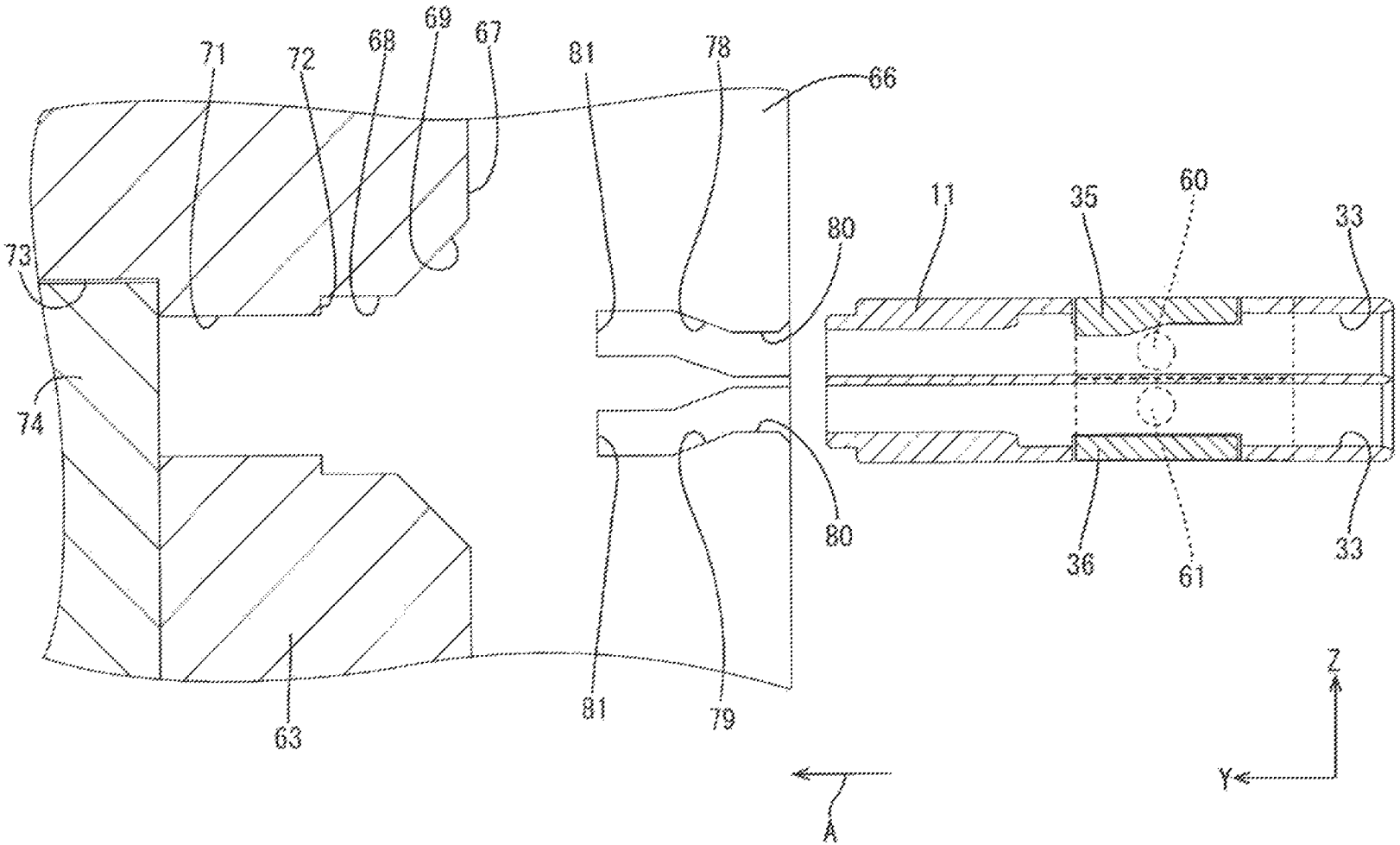
FIG. 20 is a partial enlarged section showing a state before the male connector is mounted into the jig.
Figure 21:
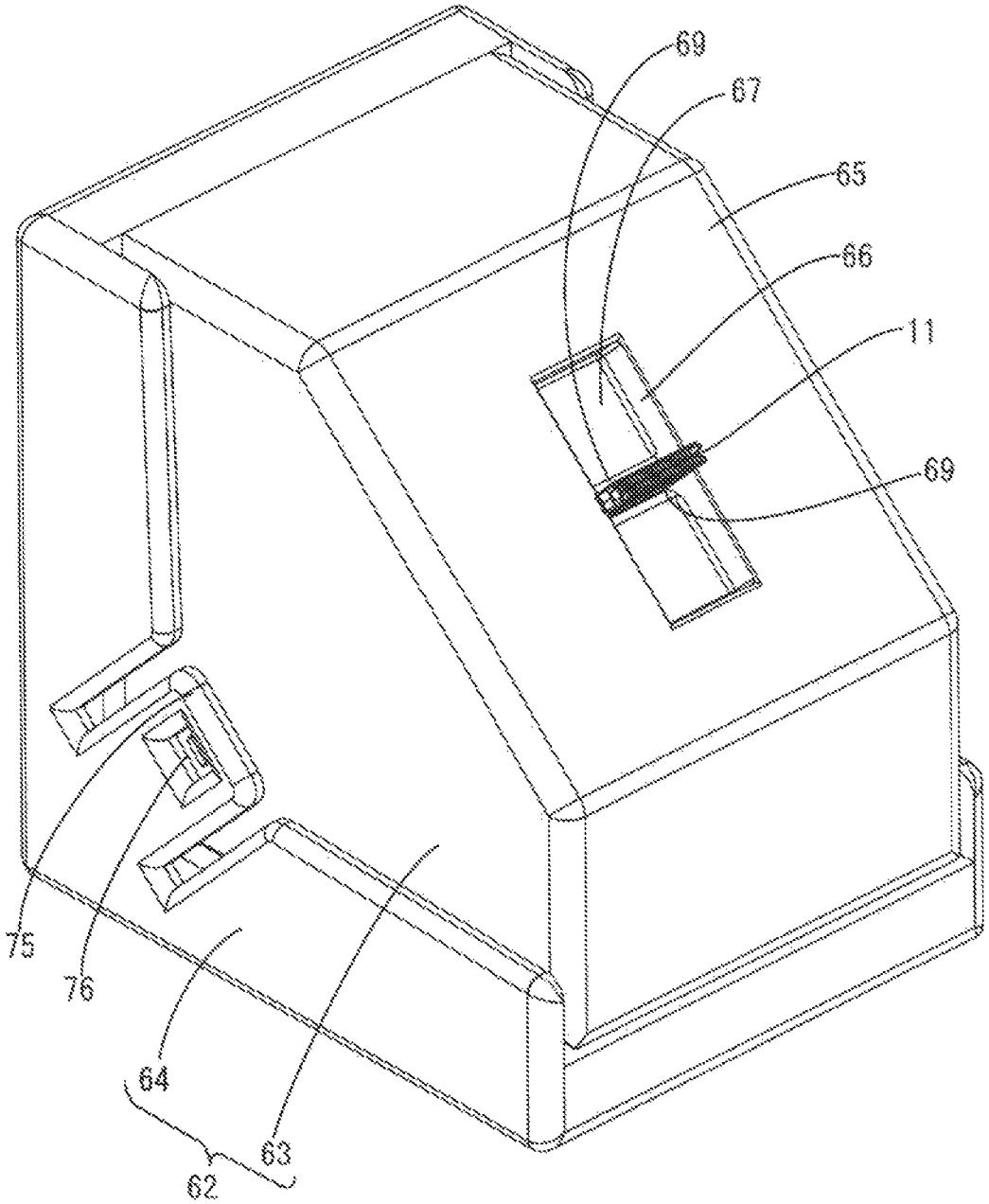
FIG. 21 is a perspective view showing a state where upper cam pins and lower cam pins are respectively fit in starting end parts of upper cam grooves and lower cam grooves.
Figure 22:
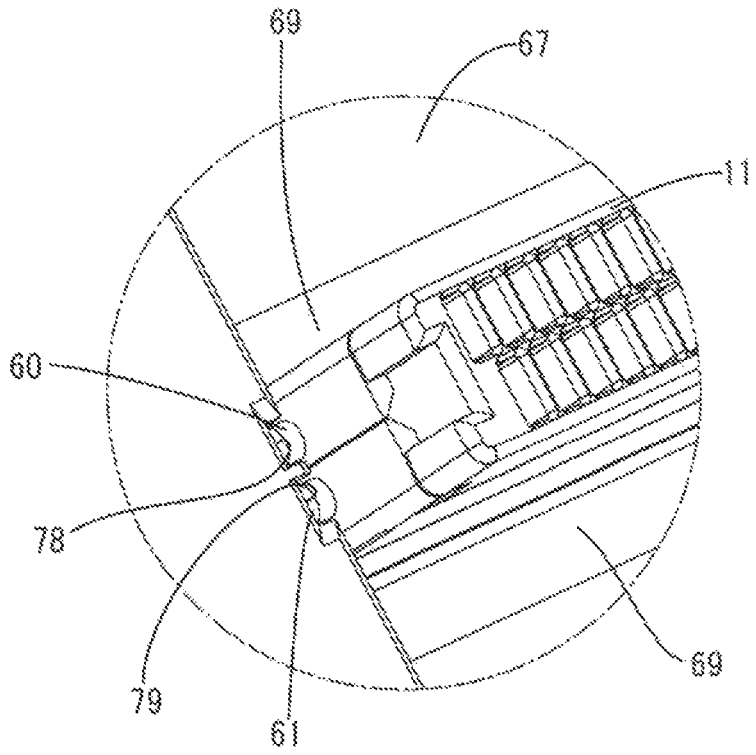
FIG. 22 is a partial enlarged perspective view of FIG. 21.

As shown in FIG. 20, the jig body 63 is formed with a cover accommodating portion 71 more deeply recessed in the inserting direction at a position in front of the connector holding recess 68. The cover accommodating portion 71 is somewhat narrower than the connector holding recess 68 in the vertical direction. In this way, steps are formed between the cover accommodating portion 71 and the connector holding recess 68. A front part of the male connector 11 contacts these steps, which serve as front stop walls 72 for suppressing a forward movement of the male connector 11.

Figure 27:
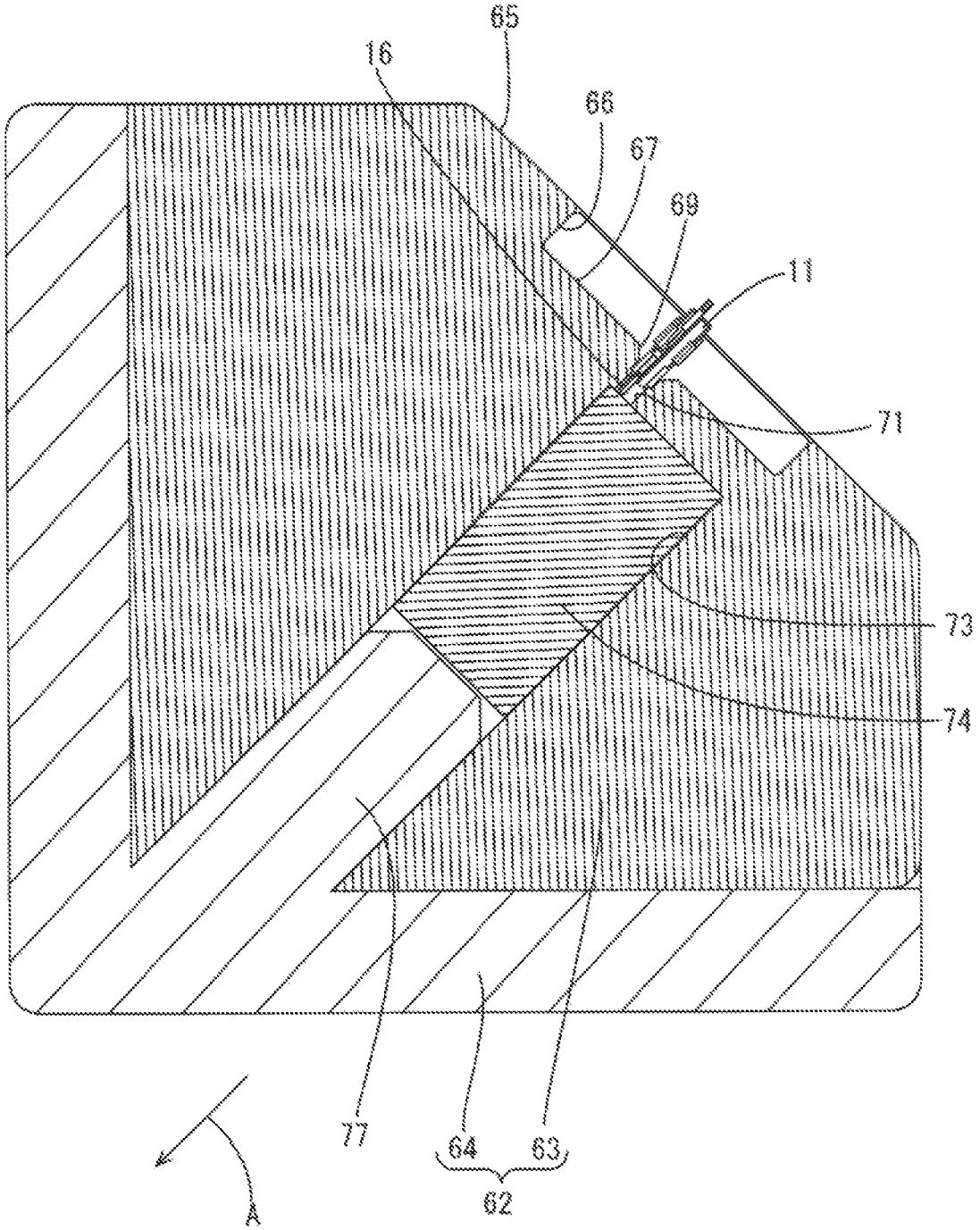
FIG. 27 is a section along B-B in FIG. 26.

As shown in FIG. 27, a magnet accommodation space 73 is at a position in front of the cover accommodating portion 71 in the inserting direction, and a magnet 74 is accommodated in this magnet accommodation space 73. The magnet 74 may be a permanent magnet or an electromagnet. A ferrite magnet, an alnico magnet or a neodymium magnet can be selected as the permanent magnet. The magnet 74 is exposed to the cover accommodating portion 71.

A depth in the inserting direction of the cover accommodating portion 71 is set so that a front part of the cover 16 is in contact with or somewhat separated from the magnet 74 with the front part of the male connector 11 held in contact with the front stop walls 72 from behind in the inserting direction and with the cover 16 located at the protection position.

As shown in FIG. 18, the front and lower surfaces of the jig body 63 are covered by the base 64. The base 64 is provided with a resiliently deformable lock 75, and the jig body 63 and the base 64 are assembled integrally by resiliently engaging this lock 75 with a lock protrusion 76 provided on an outer surface of the jig body 63.

As shown in FIG. 27, the base 64 is provided with a magnet supporting portion 77 projecting rearward with respect to the inserting direction. The magnet 74 is held at a predetermined position of the jig body 63 by being supported from below by this magnet supporting portion 77.

Figure 19:
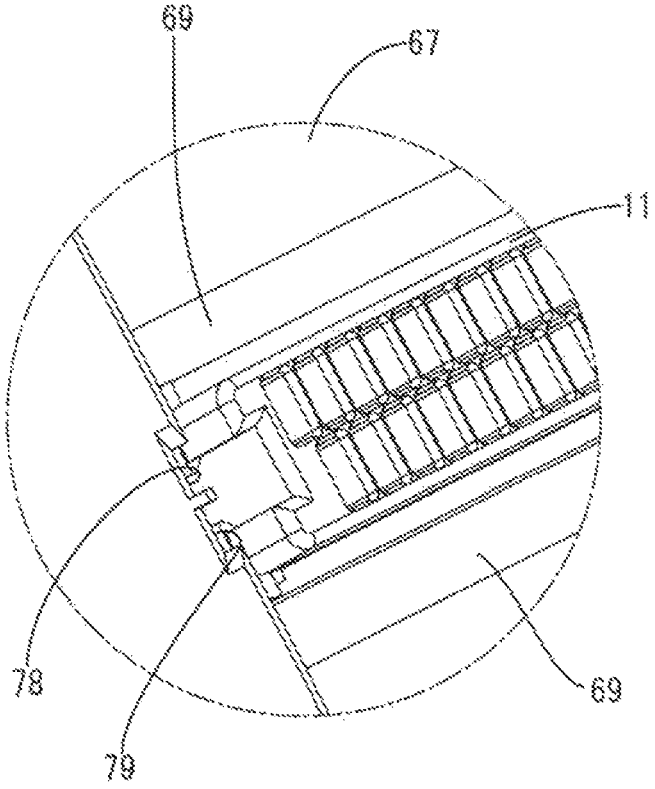
FIG. 19 is a partial enlarged perspective view of FIG. 18.

As shown in FIG. 19, an upper cam groove 78 and a lower cam groove 79 are provided in each of the left and right side walls of the accommodation recess 66 and fit respectively with the upper and lower cam pins 60 and 61.

As shown in FIG. 20, the upper cam groove 78 and the lower cam groove 79 include starting ends 80 that open rearward toward the work surface 65 with respect to the inserting direction when viewed laterally. The upper and lower cam grooves 78, 79 expand rearward with respect to the inserting direction and have bent shapes to separate from each other toward the front in the inserting direction.

With the male connector 11 inserted in the accommodation recess 66 from behind in the inserting direction and the upper and lower cam pins 60, 61 respectively fit in the starting ends 80 of the upper cam grooves 78 and the starting end parts 80 of the lower cam grooves 79, the upper and lower retainers 35, 36 are held at the full locking positions with respect to the connector housing 34.

If the male connector 11 is pushed forward with respect to the inserting direction, the upper and lower cam pins 60, 61 respectively move along the inserting direction in the upper and lower cam grooves 78, 79. The upper and lower cam grooves 78, 79 have the bent shapes to be separated from each other toward the front in the inserting direction. Thus, the upper and lower cam pins 60, 61 are separated as the male connector 11 moves forward with respect to the inserting direction. If the male connector 11 is moved farther forward with respect to the inserting direction and the upper and lower cam pins 60, 61 respectively move to final end parts 81 of the upper and lower cam grooves 78, 79, the upper and lower retainers 35, 36 are moved to the partial locking positions with respect to the connector housing 34.

When the upper and lower retainer 35, 36 are moved to the partial locking positions with respect to the connector housing 34, the upper and lower retainers 35, 36 are separated from the male terminals 10 even if the male terminals 10 are accommodated in the cavities 33 of the connector housing 34.

Assembling Process of Male Connector 11

Next, an example of an assembling process of the male connector 11 is described. First, the cover 16 is assembled with the terminal body 15 to form each male terminal 10. The front end of the tab 14 is inserted into the sheath 24 of the cover 16 from behind. Then, the assembling guiding surface 30 on the rear part of the front retaining/engaging portion 29 of the cover 16 contacts the front end part of the front retaining portion 22 of the tab 14 from the front.

The front retaining portion 22 is inclined down toward the front. Thus, the assembling guiding surface 30 of the cover 16 moves up along the upper surface of the front retaining portion 22 and the front retaining/engaging portion 29 is deformed resiliently upward. If the tab 14 is pushed farther forward, the front retaining/engaging portion 29 is restored, and the rear end of the front retaining portion 22 of the tab 14 contacts the locking surface 31 of the front retaining/engaging portion 29 of the cover 16 to prevent the cover 16 from coming off forward. Further, a rearward movement of the cover 16 is limited by the contact of the semi-locking surface 32 formed on the lower surface of the front retaining/engaging portion 29 and the front retaining portion 22 formed to be inclined down toward the front. In this way, the cover 16 is held temporarily in a semi-locked state with respect to the tab 14 at the protection position, where the tab 14 is accommodated in the sheath 24 of the cover 16 (see FIG. 8).

Subsequently, the upper and lower retainers 35, 36 are assembled with the connector housing 34 and are held at the full locking positions.

The connector housing 34 is accommodated into the accommodation recess 66 of the jig 62 from behind in the inserting direction. Then, the upper cam pins 60 are fit into the starting ends 80 of the upper cam grooves 78 and the lower cam pins 61 are fit into the starting end parts 80 of the lower cam grooves 79 (see FIG. 22).

If the connector housing 34 is pushed farther forward with respect to the inserting direction, the upper cam pins 60 move in the upper cam grooves 78, and the lower cam pins 61 move in the lower cam grooves 79 as the connector housing 34 moves forward with respect to the inserting direction. Then, forces acting in directions separating from each other are applied to the upper and lower retainers 35, 36 from the upper and lower cam pins 60, 61. In this way, the full locking portions 42A of the upper retainer 35 disengage from the lock receiving portions 43A of the connector housing 34. Additionally, the full locking portions 42B of the lower retainer 36 disengage from the lock receiving portions 43B of the connector housing 34.

Figure 23:
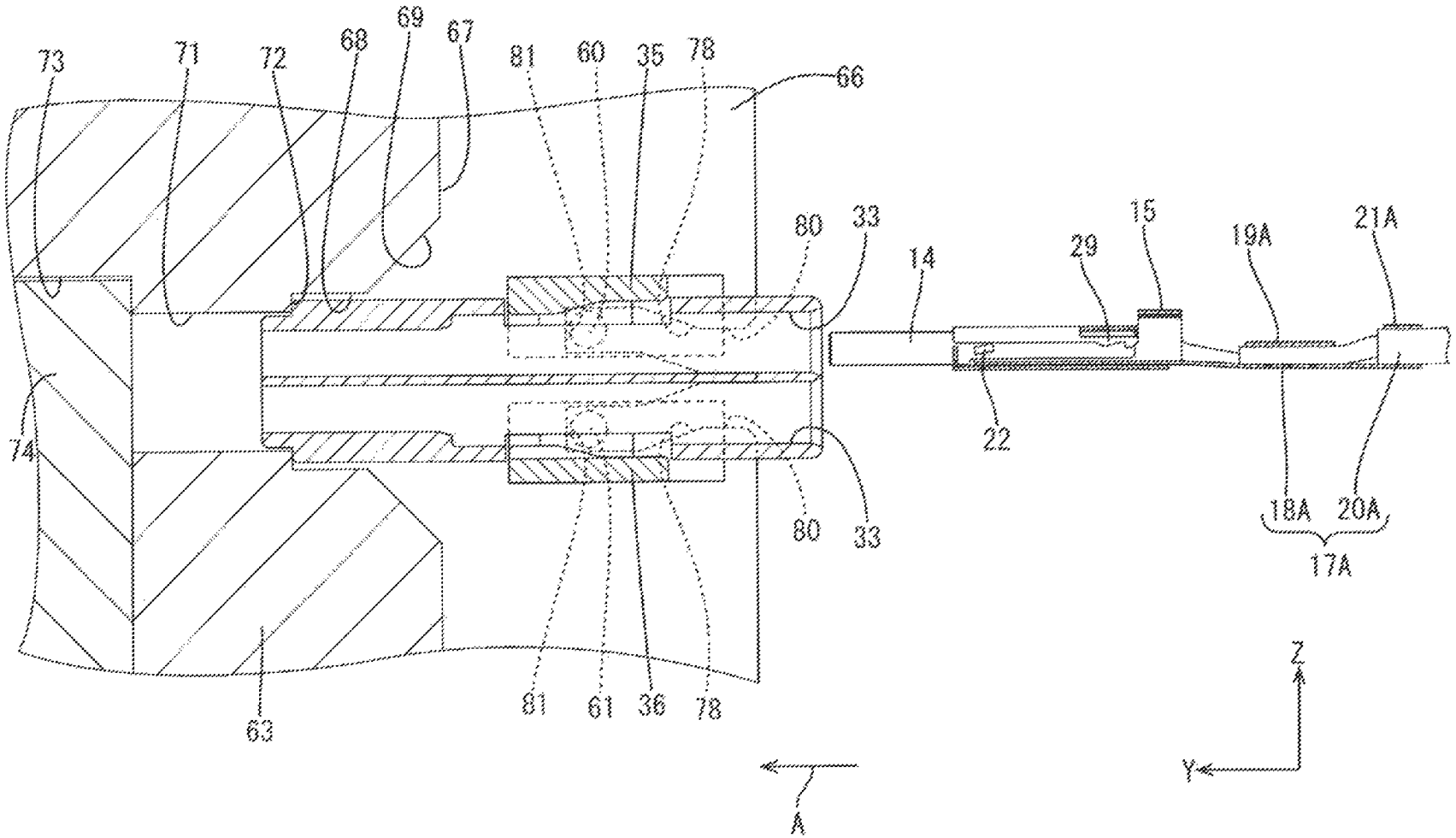
FIG. 23 is a partial enlarged section showing a state where the upper and lower cam pins are respectively fit in final end parts of the upper and lower cam grooves.

As shown in FIG. 23, the front end of the connector housing 34 contacts the front stop walls 72 from the front to complete the insertion of the connector housing 34 into the accommodation recess 66 is finished. In this state, the upper cam pins 60 have moved to the final ends 81 of the upper cam grooves 78 and the lower cam pins 61 have moved to the final ends 81 of the lower cam grooves 79. At this time, the partial locking portions 41A of the upper retainer 35 are engaged with the lock receiving portions 43A of the connector housing 34, and the partial locking portions 41B of the lower retainer 36 are engaged with the lock receiving portions 43B of the connector housing 34. In this way, the upper and lower retainers 35, 36 are held at the partial locking positions with respect to the connector housing 34.

Figure 24:
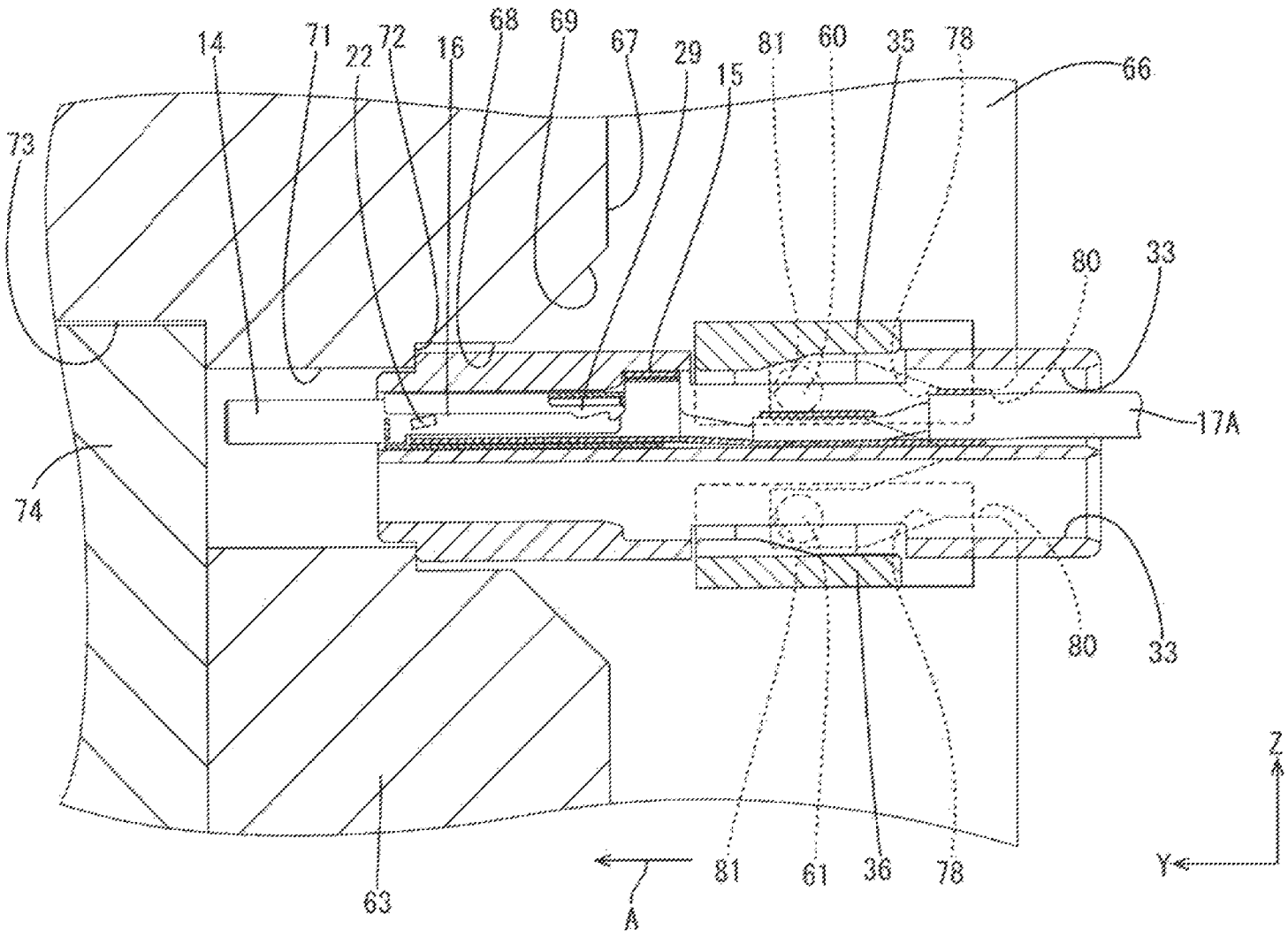
FIG. 24 is a partial enlarged section showing a state where the male terminal is inserted in a cavity of a connector housing.
Figure 25:
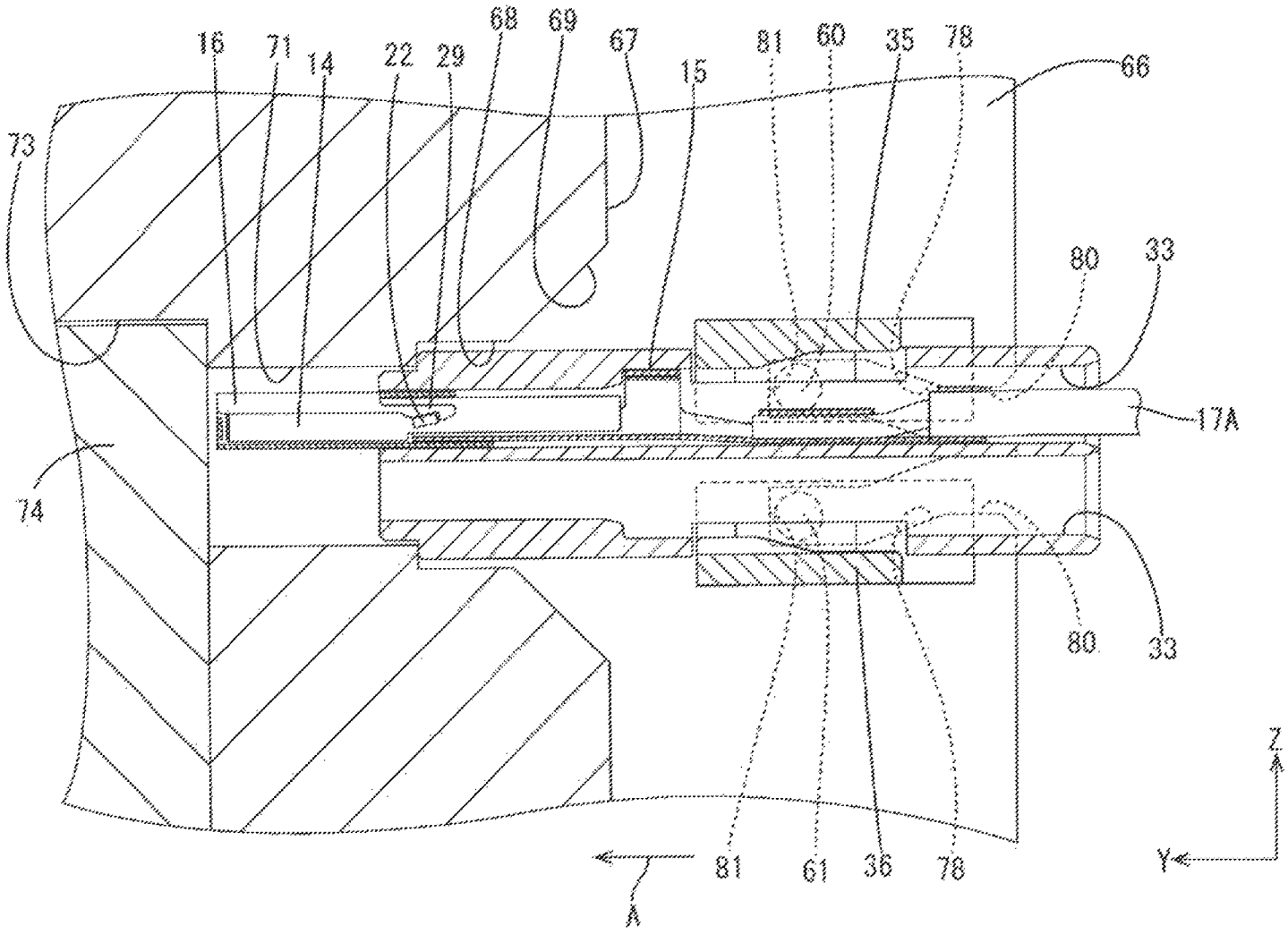
FIG. 25 is a partial enlarged section showing a state where the cover is attracted and held at the protection position by a magnetic force of a magnet.

Subsequently, the male terminal 10 is inserted into the cavity 33 of the connector housing 34 from behind in the inserting direction, as shown in FIGS. 23 and 24. The upper and lower retainers 35, 36 are held at the partial locking positions. Thus, the upper and lower retainers 35, 36 are separated from the male terminal 10, and the male terminal 10 moves forward in the cavity 33.

The terminal body 15 of the male terminal 10 comes into contact with the terminal front stop 38 of the connector housing 34 so that the male terminal 10 is stopped in front and held in the cavity 33.

Then, the cover 16 is made of the magnetic material, and a magnetic force of the magnet 74 disposed in the jig 62 attracts the cover 16 forward with respect to the inserting direction. In this way, the cover 16 is held at the protection position with respect to the terminal body 15 and the tab 14 is protected by the sheath 24 of the cover 16. At this time, even if the cover 16 is at the retracted position, the cover 16 is attracted forward with respect to the inserting direction and is held at the protection position by the magnetic force of the magnet 74 (see FIG. 25).

Subsequently, the connector housing 34 is pulled rearward with respect to the inserting direction. Then, the upper cam pins 60 move rearward with respect to the inserting direction in the upper cam grooves 78, and the lower cam pins 61 move rearward with respect to the inserting direction in the lower cam grooves 79. In this way, the upper and lower retainers 35, 36 receive forces acting in directions toward each other. As a result, the partial locking portions 41A of the upper retainer 35 and the lock receiving portions 43A of the connector housing 34 are disengaged, and the partial locking portions 41B of the lower retainer 36 and the lock receiving portions 43B of the connector housing 34 are disengaged.

By further pulling the connector housing 34 rearward with respect to the inserting direction, the upper cam pins 60 move to the starting ends 80 of the upper cam grooves 78 and the lower cam pins 61 move to the starting ends 80 of the lower cam grooves 79. In this way, the full locking portions 42A of the upper retainer 35 engage the lock receiving portions 43A of the connector housing 34. Similarly, the full locking portions 42B of the lower retainer 36 engage the lock receiving portions 43B of the connector housing 34. In this way, the upper retainer 35 contacts the terminal bodies 15 of the male terminals 10 accommodated in the cavities 33 in the upper stage from behind in the inserting direction. Similarly, the lower retainer 36 contacts the terminal bodies 15 of the male terminals 10 accommodated in the cavities 33 in the lower stage from behind in the inserting direction. Thus, the male terminals 10 are retained in the connector housing 34.

Figure 28:
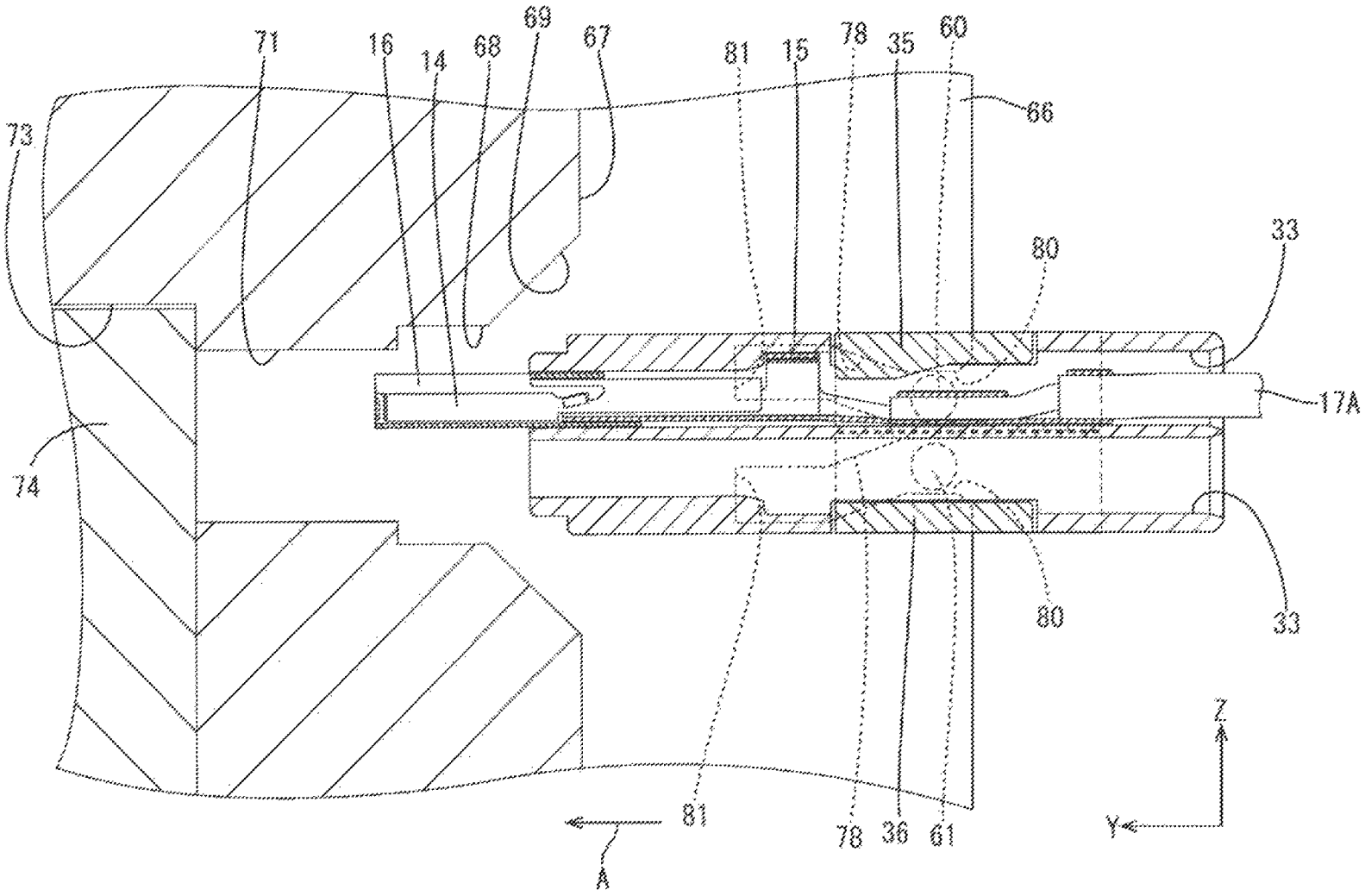
FIG. 28 is a partial enlarged section showing a state where the male connector is pulled in a direction to be separated from the jig and the upper and lower cam pins are respectively moved to the starting end parts of the upper and lower cam grooves.

With the connector housing 34 pulled out of the jig 62, the male terminals 10 accommodated in the connector housing 34 are retained and held by the upper and lower retainers 35, 36 held at the full locking positions, and the tabs 14 are protected by the covers 16 held at the protection positions (see FIG. 28). The male connector 11 is completed in the above way.

Functions and Effects of Embodiment

According to this embodiment, the male terminal 10 includes the terminal body 15 and the cover 16. The tab 14 extends forward from the terminal body 15. The cover 16 is slidable between the protection position for accommodating the tab 14 inside the sheath 24 and the retracted position for exposing the front end part of the tab 14 from the front end of the sheath 24.

According to the above configuration, the tab 14 can be accommodated into the sheath 24 by moving the cover 16 to the protection position. Thus, the tab 14 can be protected from collision from an external matter. Further, by moving the cover 16 to the retracted position to expose the tab 14, a mating terminal and the tab 14 can be connected electrically.

The tab 14 has the front retaining portion 22 that engages the front retaining/engaging portion 29 on the cover 16 from the front to restrict forward movement of the cover 16 beyond the protection position. In this way, the cover 16 is prevented from coming off forward.

The side wall of the terminal body 15 has the rear retaining portion (front end 55 of the extending wall 23) that engages the rear retaining/engaging portion 53 on the cover 16 from behind to restrict rearward movement of the cover 16 beyond the retracted position. In this way, the cover 16 is prevented from coming off rearward.

The male connector 11 according to this embodiment includes the male terminals 10, the connector housing 34 having the cavities 33 for accommodating the male terminals 10, and the upper and lower retainers 35, 36 movable with respect to the connector housing 34 between the partial locking position separated from the male terminals 10 and the full locking position for contacting and retaining the male terminals 10. The connector housing 34 has the full locking portions 42A, 42B for locking the upper and lower retainers 35, 36 and holding the upper and lower retainers 35, 36 at the full locking positions. The upper and lower cam pins 60, 61 project outward on the outer surfaces of the upper and lower retainers 35, 36. The upper and lower retainers 35, 36 are moved to the full locking positions with the upper and lower cam pins 60, 61 located in the starting ends 80 of the upper and lower cam grooves 78, 79 provided in the jig 62. The upper and lower retainers 35, 36 are moved to the partial locking positions with the upper and lower cam pins 60, 61 moved to the final ends 81 of the upper and lower cam grooves 78, 79.

Further, the jig 62 according to this embodiment includes the accommodation recess 66 for accommodating the male connector 11. The upper and lower cam grooves 78, 79 are formed in the inner wall of the accommodation recess 66, and extend along the inserting direction of the male connector 11 into the accommodation recess 66 in the inner wall of the accommodation recess 66 for receiving the upper and lower cam pins 60 and 61. The upper and lower retainers 35, 36 are moved to the full locking positions with the upper and lower cam pins 60, 61 fit in the starting ends 80 of the upper and lower cam grooves 78, 79. The upper and lower retainers 35, 36 are moved to the partial locking positions with the upper and lower cam pins 60, 61 moved to the final ends 81 of the upper and lower cam grooves 78, 79. Additionally, the magnet 74 is provided in front of the accommodation recess 66 in the inserting direction and magnetically attracts the covers 16 of the male terminals 10.

Further, an assembling method of the male connector 11 according to this embodiment includes assembling each male terminal 10 by assembling the cover 16 slidable between the protection position for accommodating the tab 14 inside the sheath 24 and the retracted position for exposing the front part of the tab 14 from the front end of the sheath 24 with the terminal body 15 including the tab 14 extending forward. The method also includes assembling the male connector 11 by assembling the upper and lower retainers 35, 36 movable with respect to the connector housing 34 between the partial locking positions separated from the male terminals 10 and the full locking positions for retaining the male terminals 10 by being held in contact with the male terminals 10 with the connector housing 34 including the cavities 33 for accommodating the male terminal 10. The method further includes moving the upper and lower retainers 35, 36 to the partial locking positions by pushing the male connector 11 into the accommodation recess 66 while fitting the upper and lower cam pins 60, 61 projecting outward on the outer surfaces of the upper and lower retainers 35, 36 into the upper and lower cam grooves 78, 79 provided in the inner wall of the accommodation recess 66 provided in the jig 62. The method then includes inserting the male terminals 10 into the cavities 33, attracting the covers 16 of the male terminals 10 by a magnetic force of the magnet 74 disposed in front of the accommodation recess 66 in the inserting direction of the male connector 11 into the accommodation recess 66 in the jig 62, and moving the upper and lower cam pins 60, 61 to the starting ends 80 of the upper and lower cam grooves 78, 79 and moving the upper and lower retainers 35, 36 to the full locking positions by pulling the male connector 11 out of the accommodation recess 66 of the jig 62.

According to the above configuration, if the male connector 11 is accommodated into the accommodation recess 66 of the jig 62, the upper and lower cam pins 60, 61 of the upper and lower retainers 35, 36 move to the final end parts 81 of the upper and lower cam grooves 78, 79 and the upper and lower retainers 35, 36 move to the partial locking positions. Since the upper and lower retainers 35, 36 are separated from the male terminals 10 in this state, the male terminals 10 are mounted into the connector housing 34.

The cover 16 including the magnetic material or the magnet is attracted to the magnet 74 in the jig 62 and moves forward with respect to the inserting direction of the male connector 11. Then, the cover 16 of the male terminal 10 moves to the protection position. In this way, the tab 14 can be accommodated into the sheath 24 of the cover 16 to protect the tab 14 from collision with external matter.

If the male connector 11 is moved rearward with respect to the inserting direction from the accommodation recess 66, the upper and lower cam pins 60, 61 move in the upper and lower cam grooves 78, 79 and reach the starting end parts 80 of the upper and lower cam grooves 78, 79. Then, the upper and lower retainers 35, 36 move to the full locking positions and are held at the full locking positions with respect to the connector housing 34. The upper and lower retainers 35, 36 held at the full locking positions retain the male terminals 10 are held in contact with the male terminals 10 and thereby retain the male terminals 10.

With the male connector 11 is pulled out of the jig 62, the male terminals 10 are retained by the upper and lower retainers 35, 36 and the tabs 14 are accommodated and protected in the covers 16. Thus, there is no need to protect the tabs 14 by moving the covers 16 when the male connector 11 is removed from the jig 62 thereby simplifying the assembling process of the male connector 11.

Other Embodiments

The invention disclosed in this specification is not limited to the above described and illustrated embodiment. For example, the following embodiments also are included in the scope of the invention.

A front retaining portion may be provided on the terminal body 15.

A rear retaining portion may be provided on the tab 14.

The magnet 74 disposed in the jig 62 may be an electromagnet.

The cover 16 may be made of a permanent magnet.

The cover 16 may be configured such that a member made of a magnetic material or permanent magnet is mounted on a front end of a member made of a non-magnetic material.

LISTING OF REFERENCE SIGNS

10: male terminal
11: male connector
14: tab
15: terminal body
16: cover
22: front retaining portion
24: sheath portion
29: front retaining/engaging portion
33: cavity
34: connector housing
35: upper retainer
36: lower retainer
42A, 42B: full locking portion
43A, 43B: partial locking portion
53: rear retaining/engaging portion
55: front end edge of extending wall (example of rear retaining portion)
60: upper cam pin
61: lower cam pin
62: jig
66: accommodation recess
74: magnet
78: upper cam groove

79: lower cam groove
80: starting end
81: final end

The invention claimed is:

1. A male connector, comprising:

a male terminal including a terminal body with a tab extending forward and a cover slidable between a protection position for accommodating the tab inside a sheath portion and a retracted position for exposing a front end part of the tab from a front end of the sheath portion, the cover including a magnet or a magnetic material;

a connector housing including a cavity for accommodating the male terminal, and a retainer movable with respect to the connector housing between a partial locking position separated from the male terminal and a full locking position for retaining the male terminal by being held in contact with the male terminal, wherein:

the connector housing is provided with a full locking portion for holding the retainer at the full locking position by locking the retainer, a cam pin projecting outward is provided on an outer surface of the retainer, and the retainer is moved to the full locking position with the cam pin located in a starting end part of a cam groove provided in a jig and the retainer is moved to the partial locking position with the cam pin moved to a final end part of the cam groove.

2. The male connector of claim 1, wherein either one of the tab and the terminal body includes a front retaining portion for restricting a further forward movement of the cover beyond the protection position by engaging a front retaining/engaging portion provided on the cover from the front.

3. The male connector of claim 2, wherein one of the tab and the terminal body includes a rear retaining portion for restricting a further rearward movement of the cover beyond the retracted position by engaging a rear retaining/engaging portion provided on the cover from behind.

4. A jig, comprising an accommodation recess for accommodating the male connector of claim 1, wherein:

a cam groove into which the cam pin is fit is formed along an inserting direction of the male connector into the accommodation recess in an inner wall of the accommodation recess, the retainer is moved to the full locking position with the cam pin fit in a starting end part of the cam groove and the retainer is moved to the partial locking position with the cam pin moved to a final end part of the cam groove, and a magnet for attracting the cover of the male terminal by a magnetic force is provided at a position in front of the accommodation recess in the inserting direction.

5. A method for assembling a male connector, comprising:

assembling a male terminal by assembling a terminal body including a tab extending forward with a cover slidable between a protection position for accommodating the tab inside a sheath portion and a retracted position for exposing a front end part of the tab from a front end of the sheath portion;

assembling the male connector by assembling a connector housing including a cavity for accommodating the male terminal with a retainer movable with respect to the connector housing between a partial locking position separated from the male terminal and a full locking position for retaining the male terminal by being held in contact with the male terminal;

moving the retainer to the partial locking position by pushing the male connector into the accommodation recess while fitting a cam pin projecting outward on an outer surface of the retainer into a cam groove provided in an inner wall of the accommodation recess provided in a jig;

inserting the male terminal into the cavity;

attracting the cover of the male terminal by a magnetic force of a magnet disposed in front of the accommodation recess in an inserting direction of the male connector into the accommodation recess in the jig; and moving the cam pin to a starting end part of the cam groove and moving the retainer to the full locking position by pulling the male connector out of the accommodation recess of the jig.

6. A jig for assembling a male connector, the male connector including a connector housing with a cavity for accommodating a male terminal, the male terminal including a terminal body with a tab extending forward and a cover slidable between a protection position for accommodating the tab inside the cover and a retracted position for exposing a front end part of the tab from a front end of the cover, the cover being made at least partly from a magnetic material, the jig comprising:

a front surface, a connector holding recess recessed into the front surface and configured for receiving the connector housing, a cover accommodating portion recessed to a position rearward from the connector holding recess and configured for receiving the cover, and a magnet at a position rearward of the cover accommodating portion, the magnet urging the cover toward the protection position as the connector housing is being removed from the connector holding recess.

7. The jig of claim 6, wherein the connector further includes a retainer movable with respect to the connector housing between a partial locking position separated from the male terminal and a full locking position for retaining the male terminal in the connector housing by being held in contact with the male terminal, a cam pin projecting outward on an outer surface of the retainer, and wherein the jig further comprises a cam groove having a starting end part toward the front surface, and a final end part rearward of the starting end part, the cam groove being disposed to engage the cam pin when the connector housing is inserted into the connector holding recess, the cam groove being configured to move the retainer to the full locking position as the cam pin is moved to the starting end part of the cam groove and to move the retainer to the partial locking position as the cam pin is moved to the final end part of the cam groove.

* * * * *